US008545093B2

(12) United States Patent
Kawata

(10) Patent No.: US 8,545,093 B2
(45) Date of Patent: Oct. 1, 2013

(54) SWITCH STRUCTURE, AND CHRONOGRAPH MECHANISM AND ELECTRONIC TIMEPIECE USING THE SAME

(75) Inventor: Masayuki Kawata, Chiba (JP)

(73) Assignee: Seiko Instruments Inc. (JP)

( * ) Notice: Subject to any disclaimer, the term of this patent is extended or adjusted under 35 U.S.C. 154(b) by 220 days.

(21) Appl. No.: 13/065,666

(22) Filed: Mar. 25, 2011

(65) Prior Publication Data

US 2011/0235473 A1 Sep. 29, 2011

(30) Foreign Application Priority Data

Mar. 25, 2010 (JP) ..... 2010-071068

(51) Int. Cl.
*G04F 8/00* (2006.01)
*G04B 29/00* (2006.01)

(52) U.S. Cl.
USPC ..... 368/319; 368/321; 368/69; 368/106; 368/112

(58) Field of Classification Search
USPC ..... 368/101–106, 110–113, 321, 308, 368/69, 224; 200/332, 337, 529, 533, 573
See application file for complete search history.

(56) References Cited

U.S. PATENT DOCUMENTS

| | | | | |
|---|---|---|---|---|
| 3,366,756 | A * | 1/1968 | Watson | 337/368 |
| 4,623,261 | A | 11/1986 | Muto | 368/80 |
| 6,428,201 | B1 * | 8/2002 | Shibuya et al. | 368/106 |
| 2004/0052162 | A1 * | 3/2004 | Takahashi | 368/101 |
| 2004/0062147 | A1 * | 4/2004 | Morokawa et al. | 368/80 |
| 2006/0114750 | A1 * | 6/2006 | Iida et al. | 368/67 |
| 2007/0097795 | A1 * | 5/2007 | Hosobuchi et al. | 368/37 |
| 2007/0206447 | A1 * | 9/2007 | Hiraya et al. | 368/112 |
| 2008/0310258 | A1 * | 12/2008 | Trifoni et al. | 368/106 |
| 2009/0034373 | A1 * | 2/2009 | Journe | 368/106 |

* cited by examiner

*Primary Examiner* — Amy Cohen Johnson
*Assistant Examiner* — Matthew Powell
(74) *Attorney, Agent, or Firm* — Adams & Wilks

(57) ABSTRACT

A switch structure has an elastic switch lever portion and a rigid support lever. The elastic switch lever portion has an elastic contact portion and an arm portion provided with a pressing force receiving portion from which the elastic contact portion extends. The rigid support lever is mounted for undergoing movement relative to the pressing force receiving portion. The rigid support lever has a rigid substrate portion and a rigid support wall portion that is connected to the rigid substrate portion and that supports the pressing force receiving portion so as to receive a pressing force from the pressing force receiving portion and to guide displacement of the pressing force receiving portion when a pressing force is applied to the pressing force receiving portion.

27 Claims, 12 Drawing Sheets

SWITCH STRUCTURE, AND CHRONOGRAPH MECHANISM AND ELECTRONIC TIMEPIECE USING THE SAME

BACKGROUND OF THE INVENTION

1. Field of the Invention

The present invention relates to a switch structure, and to a chronograph mechanism and an electronic timepiece using the the switch structure.

2. Description of the Related Art

There is known a switch structure including a terminal plate equipped with a plate-like main body portion and a switch lever portion, wherein the switch lever portion is equipped with an arm portion which is connected to an outer peripheral edge portion of the plate-like main body portion at one side of a proximal end portion and bent with respect to the outer peripheral edge portion of the plate-like main body portion at the one side of the proximal end portion and which extends from the proximal end portion along the outer peripheral edge portion of the plate-like main body portion along a surface crossing an extension surface of the main body portion, and is equipped with a pressing force receiving portion at a distal end side thereof, and an elastic contact portion further extending from the pressing force receiving portion of the arm portion (JP-A-61-83991 (FIG. 11, etc.) (Patent Document 1)). Further, there is also known a chronograph mechanism in which a start/stop (chronograph coupling) button and a reset button (for zero-restoring) are formed so as to exert a pressing force to a distal end side end portion of a corresponding switch structure, wherein a time measuring operation of a chronograph indication hand is started or stopped by a chronograph coupling lever rotated in response to the depression of the start/stop button, and wherein the chronograph indication hand is zero-restored by a zero-restoring instruction holding lever rotated in response to the depression of the reset button. Further, there is also known an electronic timepiece equipped with such a switch structure.

In the switch structure of the chronograph mechanism of an electronic timepiece of this type, the arm portion of the switch lever portion is deflected by the pressing force applied to the pressing force receiving portion situated at the distal end side of the arm portion, so that the pressing force receiving portion at the distal end side of the arm portion is not only rocked within a plane substantially parallel to a main surface of the electronic timepiece, but it almost inevitably undergoes a displacement more or less differing according to its position in a direction perpendicular to the main surface of the electronic timepiece (in the thickness direction of the electronic timepiece), so that not only is there a fear of an unexpected deviation being generated between the displacement that the start/stop button and the reset button impart to the distal end side end portion of the switch structure and the displacement of a contact portion formed at the distal end portion of an extension end portion of the arm portion, but there is also a fear of the deviation causing a problem that is not negligible in the operation of the contact with a change in the structure in the thickness direction of the timepiece.

That is, as the start/stop button or the reset button is depressed, there is a fear of a deviation being generated between various rotating operations generated in mechanical levers constituting the mechanical portion of the chronograph mechanism and the electrical on/off operation of the contact in response to the depression of the start/stop button or the reset button.

Such a deviation is more or less inevitable in a switch structure having a three-dimensional structure as described above; not only is a design of a structure of the like in which such a deviation is taken into account is complicated, but it requires a design change if the button position is just more or less changed.

SUMMARY OF THE INVENTION

It is an aspect of the present application to provide a switch structure in which the imparting of a pressing force and the operation of a contact can be effected in an appropriate manner even if there is a change in button position in the thickness direction, and to provide a chronograph mechanism and an electronic timepiece using the switch structure.

There is provided, in accordance with the present application, a switch structure including: a terminal plate equipped with a plate-like main body portion and a plurality of elastic switch lever portions, each switch lever portion being equipped with an arm portion which is connected to an outer peripheral edge portion of the plate-like main body portion at one side of a proximal end portion thereof and bent with respect to the outer peripheral edge portion of the plate-like main body portion at the one side of the proximal end portion thereof, which extends from the proximal end portion along an extension surface of the main body portion in a direction along the outer peripheral edge portion of the plate-like main body portion, and which is equipped with a pressing force receiving portion at a distal end thereof, and with an elastic contact portion further extending from the pressing force receiving portion of the arm portion; and an elastic switch lever supporting rigid support lever (rigid support lever) which is movably provided behind the pressing force receiving portion of each elastic switch lever portion in order to receive a pressing force behind the pressing force receiving portion of each switch lever portion and to guide displacement of the pressing force receiving portion when a pressing force is applied to the pressing force receiving portion of the arm portion of each elastic switch lever portion.

In the switch structure of the present application, there is provided "an elastic switch lever supporting rigid support lever which is movably provided behind the pressing force receiving portion of each elastic switch lever portion in order to receive a pressing force behind the pressing force receiving portion of each switch lever portion and to guide displacement of the pressing force receiving portion when a pressing force is applied to the pressing force receiving portion of the arm portion of each elastic switch lever portion," so that the pressing force receiving portion of the arm portion of the switch structure can make a displacement preset by the rigid support lever, whereby it is possible to suppress to a minimum the unexpected deviation between the displacement of the pressing force receiving portion to which a pressing force is imparted and the displacement of the elastic contact portion further extending from the pressing force receiving portion, and, even if the button position in the thickness direction is changed, it is possible to maintain a predetermined timing for the displacement operation due to the impartment of the pressing force and the operation of the contact. As a result, it is possible to easily change, for example, the position of the pushbutton switch in the thickness direction of the timepiece, whereby the degree of freedom for the timepiece design increases; for example, a change in the design of the timepiece can be easily made.

Typically, in the switch structure of the present application, the rigid support lever is rotatably supported.

In this case, the arm portion of the elastic switch lever portion can be supported by the rigid support lever with a relatively simple structure. In this case, of the rigid support lever, a support wall portion situated behind the pressing force receiving portion of the arm portion of the elastic switch lever portion is rotated while supporting the pressing force arm portion of the arm portion behind. In the case of rotation, deflection of the arm portion is approximated through rotation, so that the rotation center is typically at a position corresponding to approximately ⅓ from the root of the arm portion of the elastic switch lever portion. However, so long as it is possible "to receive a pressing force behind the pressing force receiving portion of each switch lever portion and to guide displacement of the pressing force receiving portion when a pressing force is applied to the pressing force receiving portion of the arm portion," it is also possible to adopt a construction which allows, for example, rocking instead of rotation and in which the one rotation center is omitted.

Typically, in the switch structure of the present application, the rigid support lever is bent in a direction opposite to the bending direction of the arm portion of each elastic switch lever portion (e.g., when the arm portion of the elastic switch lever is bent downwardly from above, it is bent upwardly from below).

In this case, sidewise deflection of the arm portion can be suppressed easily and reliably while suppressing the occupation space to a minimum. For example, in the case in which the terminal plate consists of a reference potential imparting member such as a battery positive terminal situated on the dial side of the timepiece, the proximal portion of the rigid support lever can be supported by a main plate situated on the opposite side to the terminal plate, so that a stable support can be easily effected. In this case, a pin-like rotation shaft protruding integrally from the rigid support lever may be rotatably supported by the main plate, or the rigid support lever may be rotatably supported by a pin-like shaft protruding from the main plate.

So long as the support wall portion has a rigidity high enough for the rigid support lever itself to support the pressing force receiving portion of the arm portion behind, the support wall portion may also be bent in the same direction as the arm portion instead of being bent in the opposite direction; in some cases, it may be bent along a bending line parallel to the rotation axis (i.e., in the rotating direction or in a direction opposite thereto).

Typically, in the switch structure of the present application, the elastic contact portion of each elastic switch lever portion is provided with an elastic curved arm portion curved into a U-shape.

In this case, it is easy to suppress application of an excessive pressing force to the contact portion.

In the chronograph mechanism of the present application, at least one of the start/stop button and the reset button is formed so as to exert a pressing force to the distal end side end portion of the switch structure as described above; the time measuring operation of the chronograph indication hand is started or stopped by the chronograph coupling lever rotated in response to the depression of the start/stop button, and the chronograph indication hand is zero-restored by the zero-restoring instruction lever rotated in response to the depression of the reset button.

In this case, the timing for the mechanical chronograph operation by the lever and the timing for the electronic (electric) chronograph operation by the contact can be reliably matched with each other.

Typically, in the chronograph mechanism of the present application, there is provided a hammer forcibly and mechanically zero-restoring the chronograph indication hand in response to the rotation of the zero-restoring instruction lever.

In this case, the timing for the electronic zero-restoring instruction or the like and the timing for the mechanical zero-restoring instruction or the like can be reliably matched with each other. Typically, in this case, the switch lever support lever is formed so as to displace, behind the switch lever portion, a lever related to the mechanical zero-restoring of the chronograph mechanism in response to the depression of the pushbutton.

The electronic timepiece of the present application has a switch structure as described above or a chronograph mechanism as described above.

DETAILED DESCRIPTION OF THE INVENTION

Figure 1:
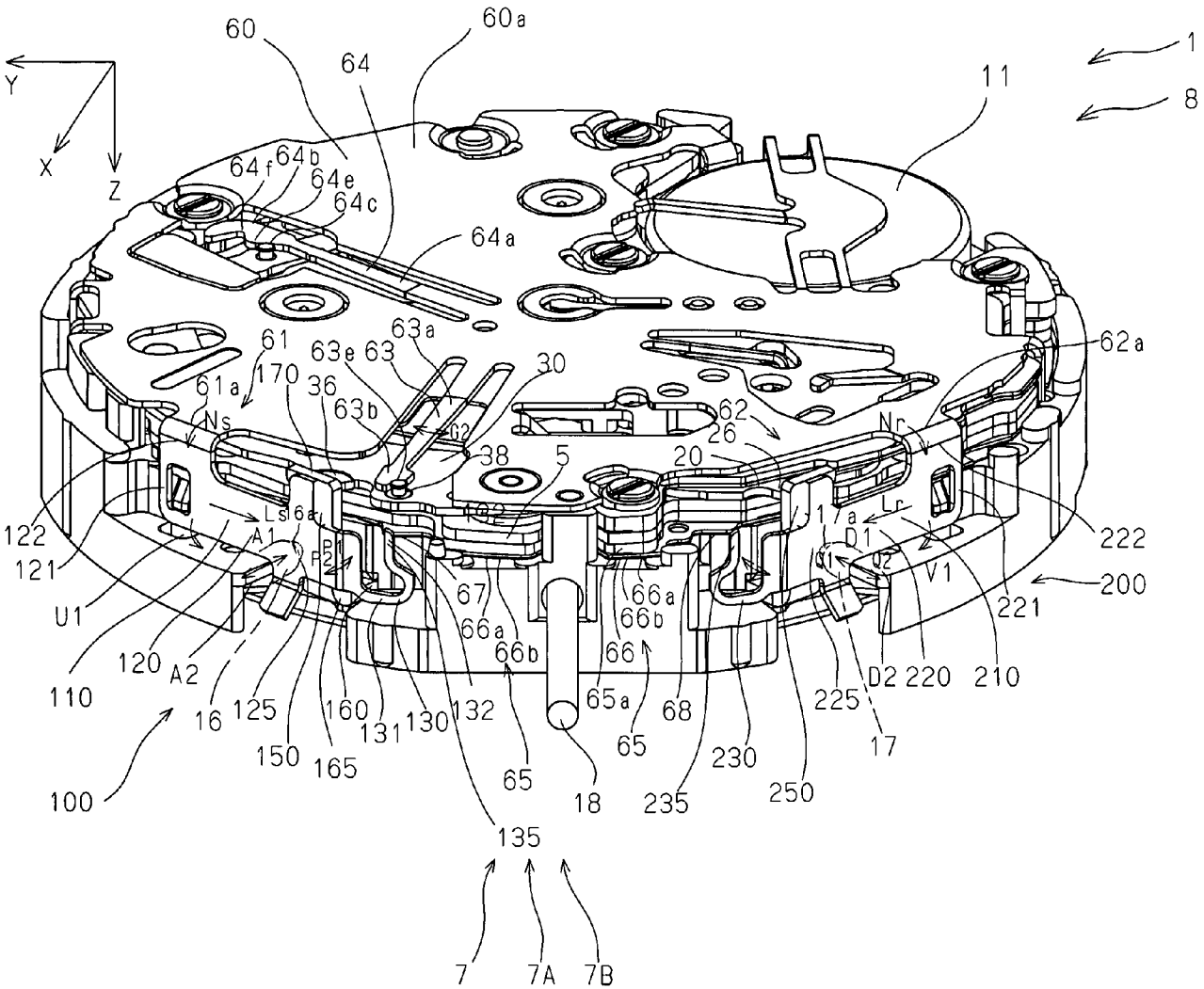
FIG. 1 shows an explanatory perspective view, as seen from the case back side and the winding stem side, of a main body portion (movement) of an electronic drive mechanical zero-restoring type chronograph timepiece as an electronic timepiece according to a preferred embodiment of the present invention having a chronograph mechanism according to a preferred embodiment of the present invention equipped with a switch structure according to a preferred embodiment of the present invention.

A preferred mode for carrying out the present invention will be described based on a preferred embodiment shown in the accompanying drawings.

[Embodiment]

A chronograph timepiece 1 according to a preferred embodiment of the present invention is endowed with a chronograph function; more specifically, it is an electronic (or electric) drive mechanical zero-restoring type chronograph timepiece 1 driven electro-mechanically and adapted to be mechanically zero-restored. In this chronograph timepiece 1, a chronograph mechanism 7 includes an electro-mechanical chronograph mechanism 7A and a mechanical chronograph mechanism 7B. As can be seen, for example, from FIG. 1 and FIGS. 9 through 11, the chronograph timepiece 1 is equipped with a normal hand movement motor 12 and a chronograph hand movement motor 13 using a battery 11 as the power source; it is driven electrically/electronically by the motors 12 and 13 via related train wheels, i.e., a normal hand movement train wheel 14 and a chronograph hand movement train wheel 15. The electro-mechanical chronograph mechanism 7A includes the chronograph hand movement motor 13 and the chronograph train wheel 15 as well as a chronograph coupling switch contact 135, 67 and a zero-restoring switch contact 235, 68 described in detail below. Numeral 19 indicates a crown, and numeral 18 indicates a winding stem.

Figure 9:
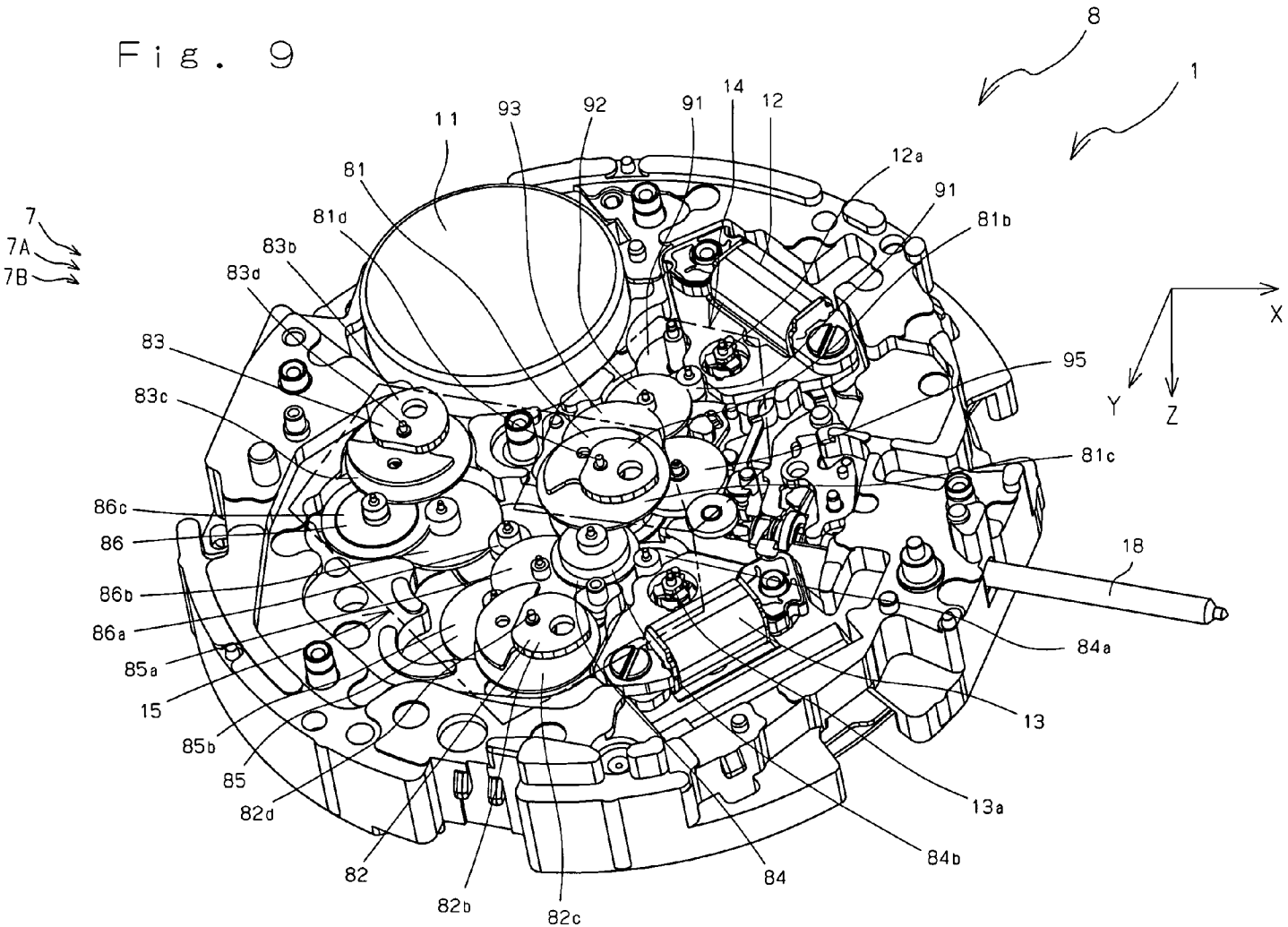
FIG. 9 shows an explanatory perspective view showing mainly a portion including a train wheel of the main body portion of the electronic timepiece of FIG. 1, with a chronograph lower plate and a train wheel bridge removed therefrom.
Figure 10:
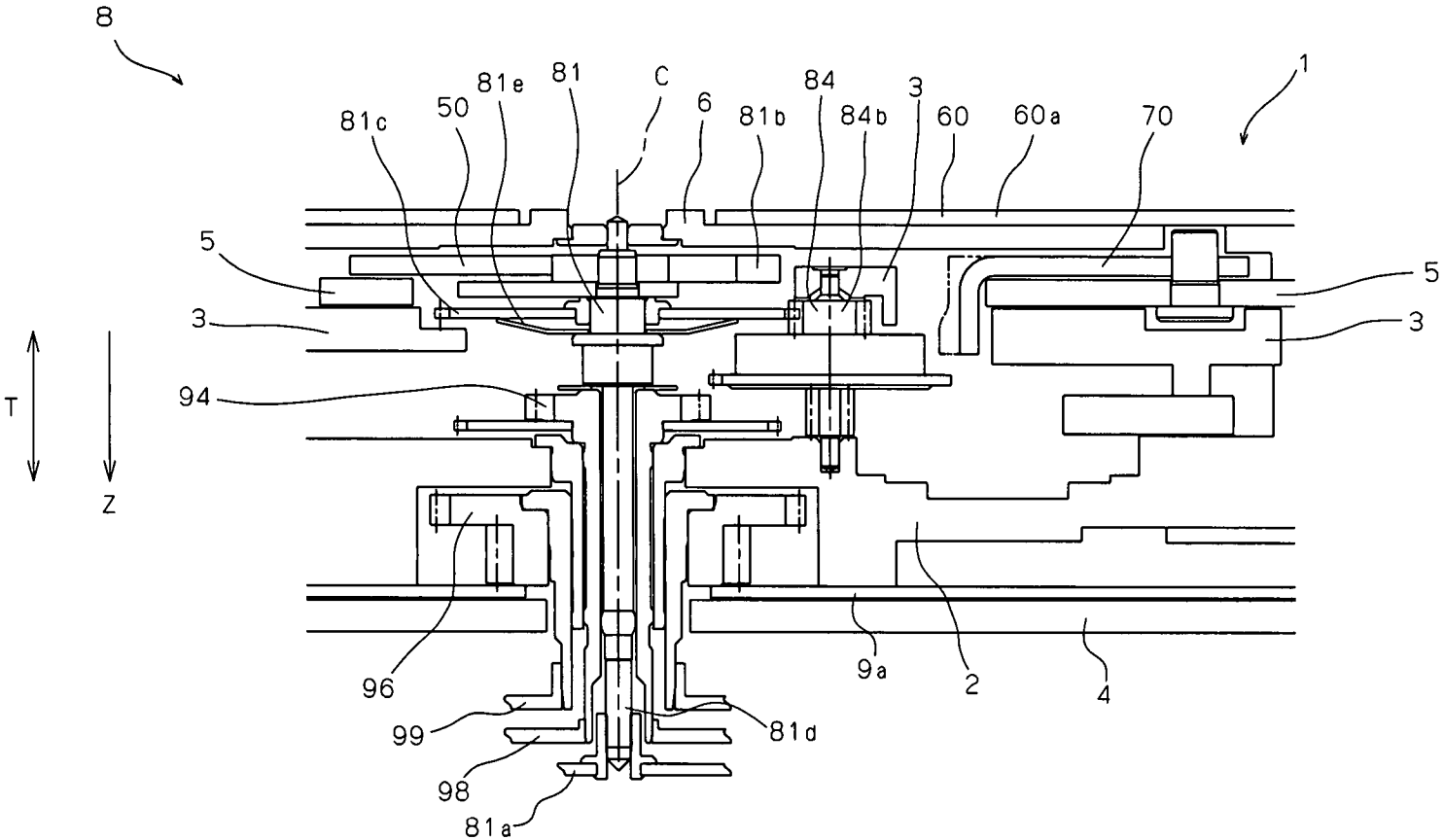
FIG. 10 shows an explanatory longitudinal sectional view of a portion including the center of the main body portion of the electronic timepiece of FIG. 1.
Figure 11:
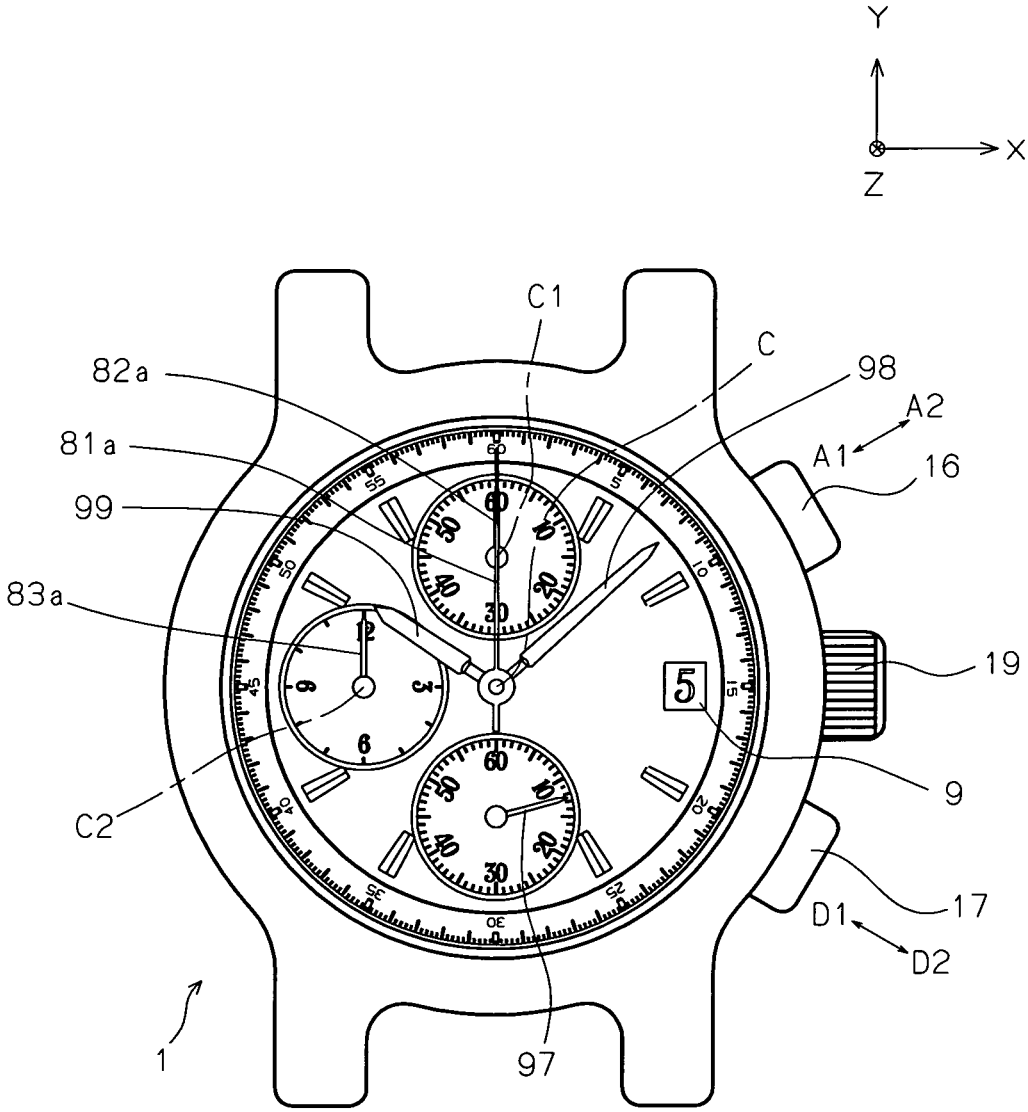
FIG. 11 shows an explanatory external plan view, as seen from the dial side, of the electronic timepiece of FIG. 1.

As can be seen from FIGS. 9 through 11, a main body or movement 8 of the chronograph timepiece 1 has a second indicator 92 rotated via a fifth wheel & pinion 91 from a rotor 12*a* of the normal hand movement motor 12, a minute indicator 94 rotated via a third wheel & pinion 93 from the second indicator 92, and an hour indicator 96 rotated via a minute wheel 95 from the minute indicator 94. A second hand 97, a minute hand 98, and an hour hand 99 are respectively mounted to the second indicator 92, the minute indicator 94, and the hour indicator 96. As can be seen from the explanatory sectional view of FIG. 10 and the external view of FIG. 11, the minute hand 98 and the hour hand 99 are rotated around a center axis C of the timepiece 1, and the second hand 97 is formed as a small second hand rotated at a position spaced apart from the center axis C. Most of the wheels 92, 93, 94, etc. of the normal hand movement train wheel 14 are supported between a main plate 2 and a train wheel bridge 3, and the hour indicator 96, etc. are supported on the dial 4 side of the main plate 2 by a date indicator maintaining plate 9*a*.

As can be seen from the explanatory sectional view of FIG. 10, the external view of FIG. 11, the explanatory perspective view of FIG. 9, etc., the chronograph timepiece 1 has a chronograph second hand 81*a* mounted to a second chronograph arbor 81*d* rotated around the center axis C, a chronograph minute hand 82*a* mounted to a minute chronograph arbor 82*d* rotated around a rotation center C1 situated at the 12 o'clock position, and a chronograph hour hand 83*a* mounted to an hour chronograph arbor 83*d* rotated around a rotation center C2 situated at the 9 o'clock position. Further, as can be seen from FIG. 9 and FIG. 5 described in detail below, hearts 81*b*, 82*b*, and 83*b* are respectively fitted to the chronograph arbors 81*d*, 82*d*, and 83*d*.

As can be seen from FIG. 10, a second chronograph cogwheel 81*c* is fit-engaged with the second chronograph arbor 81*d* so as to allow slipping rotation via a holding spring 81*e*. Similarly, as shown in FIG. 9, a minute chronograph cogwheel 82*c* is fit-engaged with the minute chronograph arbor 82*d* so as to allow slipping rotation via a holding spring (not shown), and an hour chronograph cogwheel 83*c* is fit-engaged with the hour chronograph arbor 83*d* so as to allow slipping rotation via a holding spring (not shown). Here, a second-counting wheel 81 is formed by the second chronograph arbor 81*d*, the second heart 81*b*, the second chronograph cogwheel 81*c*, etc.; a minute-counting wheel 82 is formed by the minute chronograph arbor 82*d*, the minute heart 82*b*, the minute chronograph cogwheel 82*c*, etc.; and an hour-counting wheel 83 is formed by the hour chronograph arbor 83*d*, the hour heart 83*b*, the hour chronograph cogwheel 83*c*, etc.

A chronograph train wheel 15 is substantially arranged at the level of the train wheel bridge 3 and the chronograph lower plate 5, and the hearts 81*b*, 82*b*, and 83*b* and chronograph-related levers described in detail below are mainly arranged between the chronograph lower plate 5 and a chronograph bridge 6 as seen in the thickness direction T of the chronograph timepiece 1. On the case back side of the chronograph bridge 6, there is arranged a battery positive terminal 60 as a terminal plate consisting of a spring-like metal thin plate imparting a reference potential.

On the dial side of the chronograph lower plate 5, there is arranged a circuit block 65 including a flexible circuit board 66 and a seat 65*a* supporting the board 66. The flexible circuit board 66 includes a board main body 66*a* and a conductive wiring pattern 66*b* formed on the dial side of the main body 66*a*, and, on the dial side of the conductive wiring pattern 66*b*, there are mounted various circuit components 66*c* (FIG. 8) such as a timepiece IC constituting a normal hand movement timepiece circuit and a chronograph timepiece circuit. At a position facing a chronograph coupling button 16 and at a position facing a zero-restoring button 17, the conductive wiring pattern 66*b* forms a chronograph coupling contact 67 and a zero-restoring contact 68 extending in an L-shape from the dial side surface of the board main body 66*a* to an end edge of the main body 66*a*.

The chronograph train wheel 15 includes the second-counting wheel 81 rotated by the second chronograph cogwheel 81*c* via a second chronograph intermediate wheel 84 (consisting, in this example, of second chronograph first and second intermediate wheels 84*a* and 84*b*) from a rotor 13*a* of the chronograph hand movement motor 13, the minute-counting wheel 82 rotated by the minute chronograph cogwheel 82*c* via a minute chronograph intermediate wheel 85 (consisting, in this example, of minute chronograph first and second intermediate wheels 85*a* and 85*b*) from the second chronograph second intermediate wheel 84*b*, and the hour-counting wheel 83 rotated by the hour chronograph cogwheel 83*c* via an hour chronograph intermediate wheel 86 (consisting, in this example, of hour chronograph first, second, and third intermediate wheels 86*a*, 86*b*, and 86*c*) from the minute chronograph first intermediate wheel 85*a*.

Figure 5:
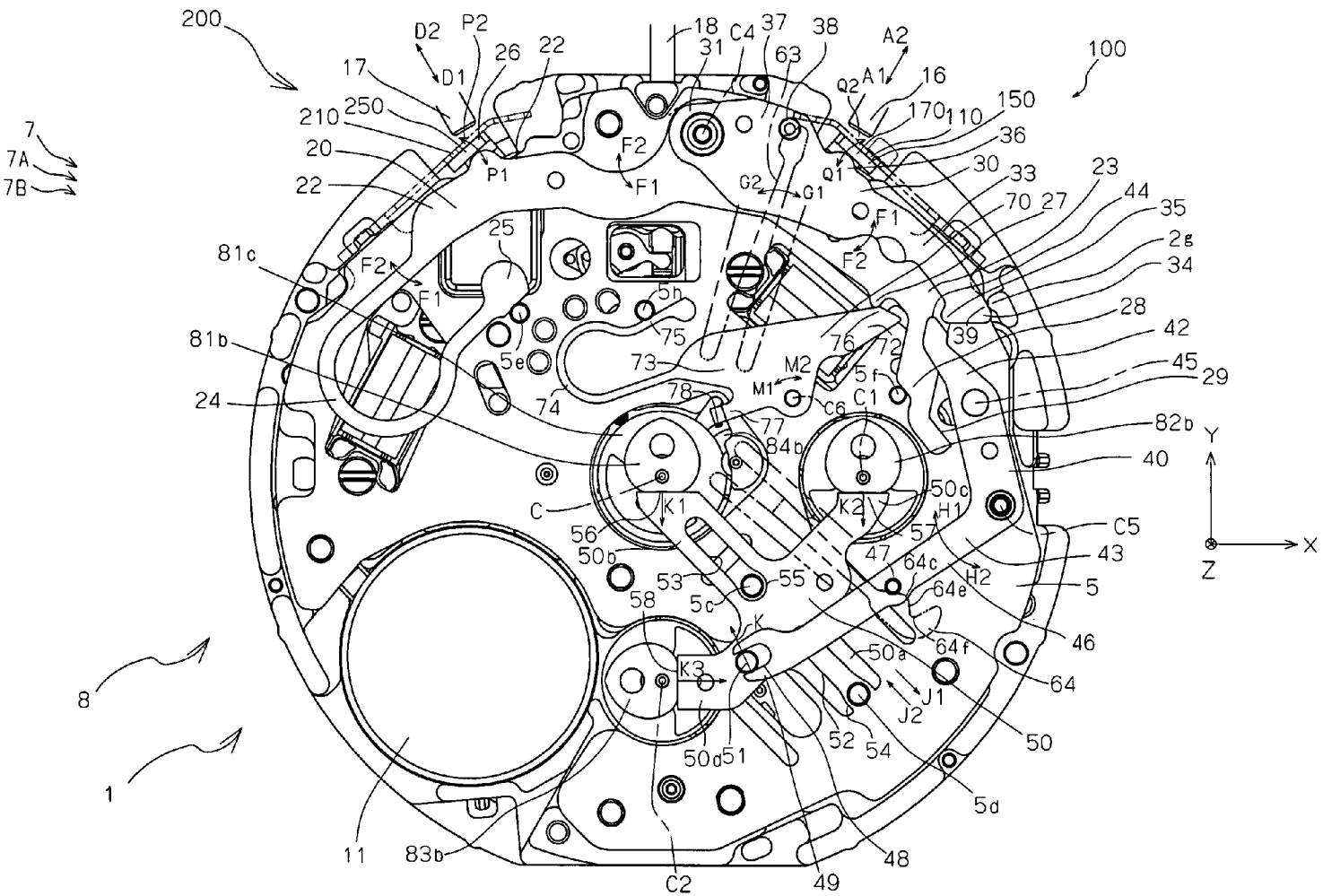
FIG. 5 shows an explanatory plan view, as seen from the case back side as in the case of FIG. 2, of the main body portion of the electronic timepiece of FIG. 1 with a battery positive terminal removed therefrom.

As can be seen, for example, from FIG. 5 in addition to the external view of FIG. 11, the mechanical chronograph mechanism 7B has, in addition to the start/stop (chronograph coupling) button 16 and the reset (zero-restoring) button 17, a zero-restoring instruction lever 20, a chronograph coupling lever 30, a hammer operating lever 40, a hammer 50, and a stop lever 70.

Figure 2:
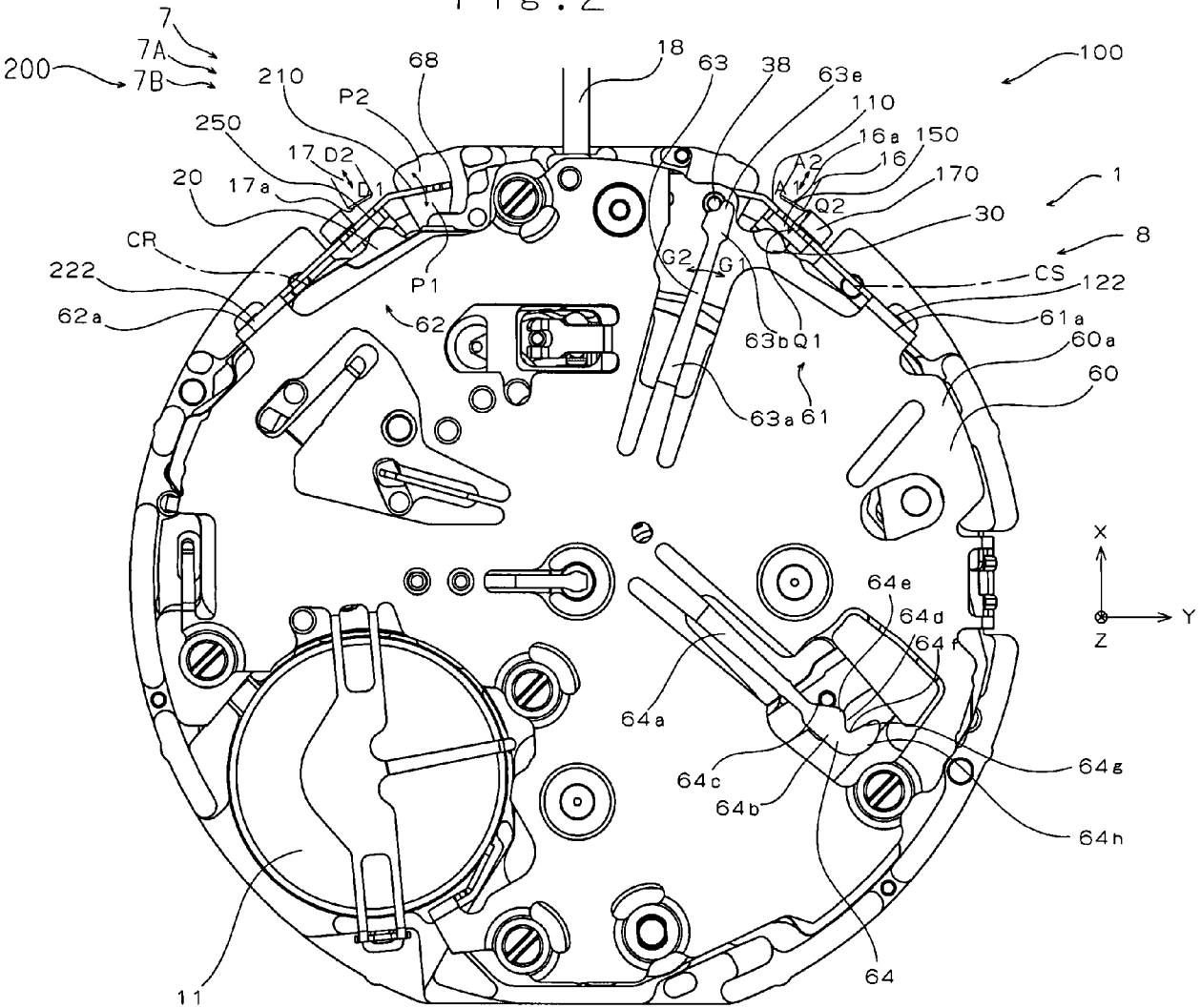
FIG. 2 shows an explanatory plan view, as seen from the case back side, of the main body portion of the electronic timepiece of FIG. 1.

As shown in FIGS. 1 and 2, the battery positive terminal 60 is a conductor imparting a reference potential to the electric circuit block, etc. of the movement 8 and consists of a component with a mechanical resiliency, that is, a resilient metal thin plate; it includes a chronograph coupling switch lever portion 110, a zero-restoring switch lever portion 210, a chronograph coupling switch spring portion 63, and hammer operating lever switch spring portion 64.

Figure 6:
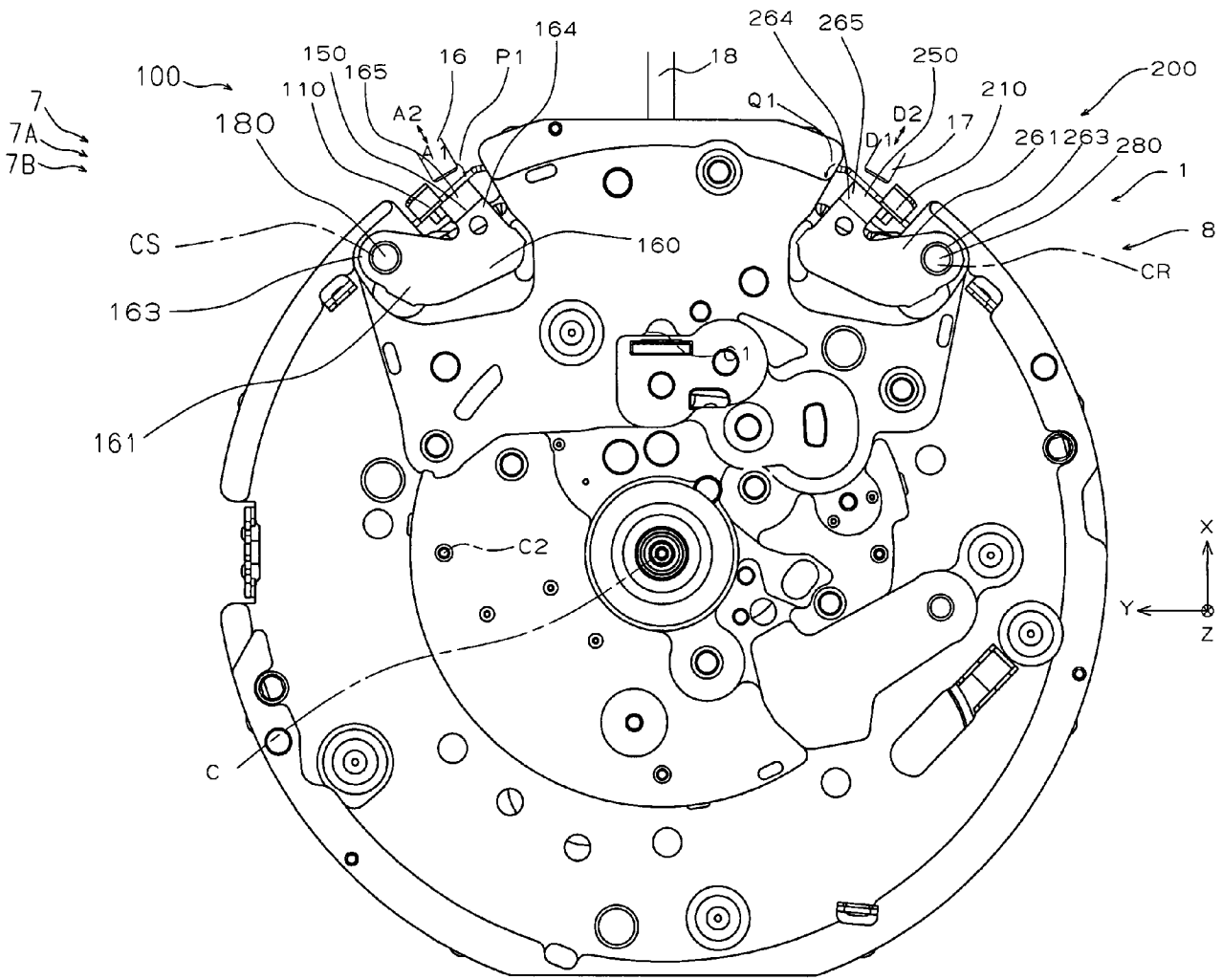
FIG. 6 shows an explanatory plan view, as seen from the dial side as in the case of FIG. 3, of the main body portion of the electronic timepiece of FIG. 1 with the components on the main plate dial side removed therefrom.

As can be seen from FIG. 6 in addition to FIGS. 1 and 2, a chronograph coupling switch structure 100 has, in addition to a chronograph coupling elastic switch lever portion 110, a chronograph coupling rigid support lever 150 rotatable around a center axis CS (FIG. 6).

Similarly, as can be seen from FIG. 6 in addition to FIGS. 1 and 2, a zero-restoring switch structure 200 has, in addition to a zero-restoring switch lever portion 210, a zero-restoring rigid support lever 250 rotatable around a center axis CR (FIG. 6).

As can be seen from FIGS. 5 and 11, the chronograph coupling button 16 can advance and retreat in directions A1 and A2; as shown in FIGS. 1 and 5, when pushed-in in the direction A1, it rocks the chronograph coupling elastic switch lever portion 110 of the chronograph coupling switch structure 100 in a direction P1 (via a contact portion described below) to generate an electric chronograph coupling signal S1; at the same time, it presses the chronograph coupling rigid support lever 150 supporting the chronograph coupling elastic switch lever portion 110 behind against the chronograph coupling lever of the mechanical chronograph mechanism 7B via the chronograph coupling elastic switch lever portion 110 to rotate the chronograph coupling lever 30 in a direction F2.

Similarly, the zero-restoring button 17 can advance and retreat in directions D1 and D2; as shown in FIGS. 1 and 5, when pushed-in in the direction D1, it rocks the zero-restoring elastic switch lever portion 210 of the zero-restoring switch structure 200 in a direction Fr1 to generate an electric zero-restoring signal S2 (via a contact portion described below); at the same time, it presses a zero-restoring rigid support lever 250 supporting the zero-restoring elastic switch lever portion 210 of the zero-restoring switch structure 200 behind against the zero-restoring instruction lever 20 of the mechanical chronograph mechanism 7B via the zero-restoring elastic switch lever portion 210 to rotate the zero-restoring instruction lever 20 in a direction F1.

As can be seen mainly from FIG. 5, the zero-restoring instruction lever 20 is supported by the chronograph lower plate 5 so as to be rotatable in the directions F1 and F2 around a rotation center axis C4, and is rotatable between an initial position and an operating position. The zero-restoring instruction lever 20 has an input side arm portion 22 on one end side of the center axis C4 and an output side arm portion on the other end side of the center axis C4. The zero-restoring instruction lever 20 has a spring portion 24 curved into a U-shape at an end portion of the input side arm portion 22, and a distal end portion 25 of the spring portion 24 is engaged with a zero-restoring instruction lever spring bearing pin 5*e*. The zero-restoring instruction lever 20 is further equipped an instruction receiving protrusion 26 on the outer side portion of the input side arm portion 22. Further, the zero-restoring instruction lever 20 is equipped with a stop lever lock protrusion 27 on the inner side edge of the output side arm portion 23; and it is equipped with a lock edge portion 28 on an inner side edge in the vicinity of the distal end portion, and an engagement edge portion 29 at the distal end portion.

Thus, in the state in which no external force is being applied thereto, the zero-restoring instruction lever 20 receives a rotational biasing force in the direction F2 from the spring portion 24, and the lock edge portion 28 assumes as an initial position a lock position where it is locked by a zero-restoring instruction lever lock pin 5*f*. On the other hand, when the zero-restoring button 17 is pushed-in in the direction D1, the pressing force in the direction D1 of the zero-restoring button 17 is applied to a protrusion 26 of the input side arm portion 22 of the zero-restoring instruction lever 20 via the zero-restoring switch mechanism 200, and the zero-restoring instruction lever 20 is rotated in the direction F1 around the rotation center axis C4; (unless it is in a state in which resetting has already been effected, with the hammer operating lever 40 reaching an operating position (zero-restoring operation position) as the zero-restoring operation control position), the engagement edge portion 29 at the distal end of the output side arm portion 23 is engaged with the hammer operating lever 40.

As can be seen mainly from FIG. 5, the chronograph coupling lever 30 has one end portion 31 situated in the vicinity of the center axis C4 and constituting a proximal end portion, and an arm portion 33 extending in one direction from the center axis C4; at the same time, it has a hammer operating lever pressing protrusion 35 on one side of an extension end portion 34 of the arm portion 33. The chronograph coupling lever 30 is supported by the chronograph lower plate 5 so as to be rotatable in the directions F1 and F2 around the common rotation center axis C4, and is rotatable in the directions F2 and F1 between an initial position and an operating position. Due to the presence of the common rotation center C4, the two levers 20 and 30 can practically share the same rotation region, so that it is possible to minimize the occupation area. Further, the chronograph coupling lever 30 is equipped with a protrusion 36 at an outer edge portion of the arm portion 33, and a pin-like protrusion 38 engaged with a chronograph coupling switch spring portion 63 of the battery positive terminal 60 is provided on a main surface (case back side main surface) 37 facing the battery positive terminal 60 between the center axis C4 portion of the arm portion 33 and the protrusion 36 portion thereof. Further, the chronograph coupling lever 30 is equipped, at the distal end outer edge portion, with an engagement edge portion 39 locked to a lock protrusion 2*g* of the main plate 2. As can be seen from FIGS. 1, 2, etc., the switch spring portion 63 has a long and thin spring main body portion 63*a* and a distal end engagement portion 63*b* formed in the vicinity of the distal end portion of the spring main body portion 63*a*. The distal end engagement portion 63*b* is equipped with a shoulder portion 63*e* in the form of a step portion. The protrusion 38 of the chronograph coupling lever portion 30 can be displaced between a position where it is in contact with the shoulder portion 63*e* and a position where it has got over the shoulder portion 63*e*, with the spring main body portion 63*a* being curved in a direction G1.

Thus, in a state in which no external force is being applied thereto, the chronograph coupling lever 30 receives a rotational biasing force in the direction F1 by the shoulder portion 63*d* of the chronograph coupling switch spring portion 63, and the engagement edge portion 39 assumes the initial position where it is locked by the lock protrusion 2*g*. On the other hand, when the chronograph coupling button 16 is pushed-in in the direction A1, the pressing force in the direction A1 of the chronograph coupling button 16 is applied to the protrusion 36 of the chronograph coupling lever 30 via the chronograph coupling switch mechanism 100, and the chronograph coupling lever 30 is rotated in the direction F2 around the rotation center axis C4; and (when the hammer operating lever 40 has not been returned to the initial position (non-zero-restoring position) as the chronograph coupling control position), the hammer operating lever pressing protrusion 35 on one side of the extension end portion 34 of the arm portion 33 is engaged with the hammer operating lever 40. With the rotation in the direction F2 of the chronograph coupling lever 30, the pin-like protrusion 38 of the chronograph coupling lever 30 curves the chronograph coupling switch spring portion 63 in the direction G1. When the pin-like protrusion 38 is displaced along the proximal end side long side surface beyond the shoulder portion 63*e*, the resistance to the pushing-in in the direction A1 of the chronograph coupling button 16 is abruptly reduced, thereby giving a click feel to the user. When the pressing force in the direction A1 of the chronograph coupling button 16 is released, under the action of the restoring force in the direction G2 of the main body portion 63*a* of the switch spring portion 63, the protrusion 38 of the chronograph coupling lever 30 is returned from the position where it is engaged with the proximal end side long side surface of the distal end engagement portion 63*b* of the switch spring portion 63 to the position where it is engaged with the shoulder portion 63*e*, and the chronograph coupling lever 30 is returned in the direction F1, with the chronograph coupling button 16 being also returned in the direction A2 via the chronograph coupling switch mechanism 100.

As can be seen from FIG. 5, the hammer operating lever 40 is supported by the chronograph lower plate 5 so as to be rotatable in the directions H1 and H2 around the center axis C5, and has an input side arm portion 42 on one end side of the center axis C5 and an output side arm portion 43 on the other end side of the center axis C5. The input side arm portion 42 is equipped with a chronograph coupling lever engagement portion 44 at one side edge portion of the distal end thereof, and is equipped with a zero-restoring instruction lever engagement pin-like protrusion 45 protruding from the main surface on the side facing the chronograph lower plate 5. As described above, the chronograph coupling lever 30 and the zero-restoring instruction lever 20 are engaged with the lever from the opposite side in order to rotate the hammer operating lever 40 in an opposite direction. That is, the hammer operating lever 40 is rotatable in the directions H1 and H2 between the initial position (non-zero-restoring operation position) constituting the chronograph coupling control position and the operating position (zero-restoring operation position) constituting the zero-restoring operation control position. When the hammer operating lever 40 is at the operating position (zero-restoring operation position) as shown in FIG. 5, rotating the chronograph coupling lever 30 in the direction F2 from the initial position to the operating position causes the hammer operating lever pressing protrusion 35 of the chronograph coupling lever 30 to abut the chronograph coupling lever engagement portion 44 of the input side arm portion 42 of the hammer operating lever 40 to rotate the hammer operating lever 40 in the direction H2 toward the non-zero-restoring operation position. On the other hand, when the hammer operating lever 40 is at the initial position (non-zero-restoring operation position) where it has been rotated in the direction H2, rotating the zero-restoring instruction lever 20 in the direction F1 from the initial position to the operating position causes the engagement edge portion 29 of the zero-restoring instruction lever 20 to abut the zero-restoring instruction lever engagement pin-like protrusion 45 of the input side arm portion 42 of the hammer operating lever 40 to rotate the hammer operating lever 40 in the direction H1 toward the zero-restoring operation position.

Further, the hammer operating lever 40 has, on the main surface (case back side main surface) 46 on the side of the output side arm portion 43 facing the battery positive terminal 60, a pin-like protrusion 47 engaged with the hammer operating lever switch spring portion 64, and, has, at the distal end, a hammer operating portion 49 equipped with an engagement groove portion 48 in the form of a U-shaped recess with which a hammer operating pin 51 of a hammer 50 is loosely fit-engaged. As can be seen from FIGS. 1 and 2, the switch spring portion 64 with which the pin-like protrusion 47 is engaged is equipped with a main body portion 64*a* in the form of a long and thin spring and an engagement portion 64*b* at the distal end. The distal end engagement portion 64*b* is equipped with a protrusion 64*e* equipped with inclined portions 64*c* and 64*d*, and a protrusion 64*h* providing an inclined portion 64*g* cooperating with the distal end side inclined portion 64*d* to form a recess 64*f*. The proximal end side inclined portion 64*c* is continuously connected with the side edge of the main body portion 64*a*.

Thus, the pin-like protrusion 47 of the hammer operating lever 40 is movable between a state in which it is inside the recess 64*f* on the distal end side inclined portion 64*d* side of the protrusion 64*e* (which corresponds to the initial position (non-zero-restoring operation position) of the hammer operating lever 40), and a state in which it is situated on the proximal end side inclined portion 64*c* side of the protrusion 64*e* (which corresponds to the operating position (zero-restoring operation position) of the hammer operating lever 40). Strictly speaking, the operating position (zero-restoring operation position) of the hammer operating lever 40 is the position of the hammer operating lever 40 where the hammer 50 assumes the operating position (zero-restoring operation position) described below. In the case where the pin-like protrusion 47 of the hammer operating lever 40 is situated at the apex of the protrusion 64*e*, the zero-restoring operation by the hammer 50 has not been performed yet (at least not completed yet).

That is, when the hammer operating lever 40 is rotated in the direction H2 by the chronograph coupling lever 30 and the pin-like protrusion 47 gets beyond the apex of the protrusion 64*e* of the switch spring portion 64, it is displaced along the distal end side inclined portion 64*d* under the action of the spring force of the switch spring portion 64, so that the hammer operating lever 40 is further rotated in the direction H2 to finally assume the initial position (non-zero-restoring operation portion), displacing the hammer 50 to the non-zero-restoring position (open position) via the hammer operating pin 51 loosely engaged with the U-shaped engagement groove portion 48. When the pin-like protrusion 47 is situated in the recess 64*f* of the switch spring 64 and the hammer operating lever 40 is at the initial position (non-zero-restoring operation position), the hammer operating lever 40 is rotated to a maximum degree in the direction H2, and the chronograph coupling lever engagement portion 44 of the hammer operating lever 40 assumes the position where it has been rotated to a maximum degree in the direction H2, so that if, in this state, the start/stop button (chronograph coupling button) 16 is pushed in to a maximum degree in the direction A1, and the chronograph coupling lever 30 is rotated to a maximum degree in the direction F2, the hammer operating lever pressing protrusion 35 of the chronograph coupling lever 30 does not abut the chronograph coupling lever engagement portion 44 of the hammer operating lever 40, and a gap remains between the hammer operating lever pressing protrusion 35 of the chronograph coupling lever 30 and the chronograph coupling lever engagement portion 44 of the hammer operating lever 40. On the other hand, when the pin-like protrusion 47 has got beyond the protrusion 64*e* of the switch spring 64 to be situated on the proximal end side inclined portion 64*c* side, and the hammer operating lever 40 is at the operating position (zero-restoring operation position), the hammer operating lever 40 is rotated to a maximum degree in the direction H1, and the zero-restoring instruction lever engagement pin-like protrusion 45 of the hammer operating lever 40 assumes a position where it has been rotated to a maximum degree in the direction H1, so that, if, in this state, the reset button (zero-restoring button) 17 is pushed in to a maximum degree in the direction D1, and the zero-restoring instruction lever 20 is rotated to a maximum degree in the direction F1, the engagement edge portion 29 of the zero-restoring instruction lever 20 does not abut the zero-restoring instruction lever engagement pin-like protrusion 45 of the of the hammer operating lever 40, and a gap remains between the engagement, edge portion 29 of the zero-restoring instruction lever 20 and the zero-restoring instruction lever engagement pin-like protrusion 45 of the hammer operating lever 40. On the other hand, when the hammer operating lever 40 is rotated in the direction H1 by the zero-restoring instruction lever 20, and the pin-like protrusion 47 gets beyond the apex of the protrusion 64*e* of the switch spring portion 64, it is displaced along the proximal end side inclined portion 64*c* under the action of the spring force of the switch spring portion 64, so that the hammer operating lever 40 is further rotated in the direction H1 to finally assume the operating position (zero-restoring operation position), displacing the hammer 50 to the zero-restoring position via the hammer operating pin 51 engaged with the engagement groove portion 48 in the form of a U-shaped recess.

As can be seen from FIG. 5, the stop lever 70 is supported by the chronograph lower plate 5 so as to be rotatable in directions M1 and M2 around a rotation center axis C6, and is rotatable between an initial position (non-stop position) and an operating position (stop position). The stop lever 70 has a first arm portion 72 at one end side of the rotation center axis C6 and a second arm portion 73 at the other end side of the rotation center axis C6; at an end portion of the second arm portion 73, there is formed a spring portion 74 curved into a U-shaped, and a distal end portion 75 of the spring portion 74 is engaged with a stop lever spring bearing pin 5*h*. Further, the stop lever 70 is equipped with a locked portion 76 on the outer side portion of the first arm portion 72. Further, the stop lever 70 is equipped, on a branching arm portion 77 of the second arm portion 73, with a chronograph intermediate wheel setting edge portion 78 bent in the thickness direction T of the timepiece 1, extending in the thickness direction T, and protruding laterally.

As shown in FIG. 5, in the state in which the locked portion 76 of the first arm portion 72 is locked by the stop lever locking protrusion 27 of the zero-restoring instruction lever 20 at the non-operating position, the stop lever 70 assumes the non-stop position where it has been rotated in the direction M2 against the spring force of the spring portion 74. When the stop lever 70 is at this non-stop position, the chronograph intermediate wheel setting edge portion 78 of the branching arm portion 77 of the stop lever 70 assumes a position spaced apart from a second counter second intermediate wheel 84*b*, permitting rotation of the second counter second intermediate wheel 84*b*. On the other hand, when the zero-restoring instruction lever 20 is rotated in the direction F1, the lock of the locked portion 76 of the first arm portion 72 by the stop lever locking protrusion 27 of the zero-restoring instruction lever 20 is released. Thus, the stop lever 70 is rotated in the direction M1 by the force of the spring portion 74, and the chronograph intermediate wheel setting edge portion 78 of the branching arm portion 77 of the stop lever 70 assumes the operating position (stop position) where it is engaged with the second counter second intermediate wheel 84*b*, setting the second counter second intermediate wheel 84*b* to prohibit rotation of the second-counting cogwheel 81*c* (FIG. 9) in mesh with the second counter second intermediate wheel 84*b*. As described below, the timing with which the stop lever 70 assumes the stop position is slightly earlier than the timing with which the mechanical zero-restoring of the hearts 81*b*, 82*b*, and 83*b* is effected by hammers 56, 57, and 58.

The hammer 50 is generally of a configuration like a flying bird, and has a head portion side arm portion 50*a*, a body tail portion side arm portion 50*b*, and wing side arm portions 50*c* and 50*d*. The head portion side arm portion 50*a* of the hammer 50 has a guide groove portion 52 constituting a hammer guide portion in the form of a long and thin opening, and the body tail portion side arm portion 50*b* of the hammer has a guide hole portion or guide elongated hole portion 53 cooperating with the guide groove portion 52 to constitute the hammer guide portion in the form of a long and thin opening. The guide groove portion 52 and the guide hole portion 53 are fit-engaged with first and second hammer guide pins 5*d* and 5*c* protruding from the surface of the chronograph lower plate 5 facing the chronograph bridge 6. Here, there are slight gaps between the outer peripheries of the first and second hammer guide pins 5*d* and 5*c* and the inner surfaces of the guide groove portion 52 and the guide hole portion 53. Thus, the hammer 50 can move in directions J1 and J2 in the direction in which the guide groove portion 52 and the guide hole portion 53 extend. At one ends of the guide groove portion 52 and the guide hole portion 53, there are respectively formed a groove portion 54 and a hole portion 55 which are somewhat larger than the other portions of the groove portion 52 and the hole portion 53. Thus, in the case in which the first and second hammer guide pins 5*d* and 5*c* are situated in the groove portion 54 and the hole portion 55, the orientation of the hammer 50 can also be changed to some degree. A hammer operating pin 51 protrudes from the right wing side arm portion 50*d* of the hammer 50, and the hammer operating pin 51 is fit-engaged with the U-shaped groove portion 48 of the hammer operating portion 49 of the output side arm portion 43 of the hammer operating lever 40 and receives an operating force K upon rotation in the direction H1 of the hammer operating lever 40 to be displaced in the direction J1. Further, the hammer 50 has, at the distal end portion of the body tail side arm portion 50*b*, a second heart contact portion 56 as a second hammer, and has, at the distal end portion of the left wing side arm portion 50*c*, a minute heart contact portion 57 as a minute hammer; further, it has, at the distal end portion of the right wing side arm portion 50*d*, an hour heart contact portion 58 as an hour hammer.

Thus, in the chronograph mechanism 7B, when the hammer operating lever 40 is rotated in the direction H1 in response to the depression in the direction D1 of the reset pin 17, the hammer operating pin 51 of the hammer 50 receives the force K due to the hammer operating portion 49 of the output side arm portion 43 of the hammer operating lever 40, and the hammer is guided by the guide pins 5*d* and 5*c* by virtue of the guide groove 52 and the guide hole 53 to be displaced in the direction J1, and the second heart contact portion 56 abuts or comes into press contact with the second heart 81*b*; at the same time, the minute heart contact portion 57 abuts or comes into press contact with the second heart 82*b*, and the hour heart contact portion 83*b* just abuts or comes into press contact with the hour heart 83*b*. Here, when the heart contact portions 56, 57, and 58 reach a region where they come into contact with the second, minute, and hour hearts 81*b*, 82*b*, and 83*b*, the line of action of the operating force K is oriented in a direction in which the center axis C passes. When the abutment state or press contact state is attained, the guide pins 5*d* and 5*c* are just situated in the relatively large groove portion 54 and hole portion 55 of the guide groove 52 and the guide hole 53, so that there is realized a state in which the contact portions (hammers) 56, 57, and 58 of the hammer 50 just abut or come into press contact with the minimum diameter portions of the corresponding hearts 81*b*, 82*b*, and 83*b*. At this time, the force K with which the hammer operating portion 49 of the output side arm portion 43 of the hammer operating lever 40 presses the hammer 50 via the hammer operating pin 51 is just in equilibrium with the resultant force of the force K1 with which the second heart 81*b* presses the hammer 50 by virtue of the second heart contact portion (second hammer) 56, the force K2 with which the minute heart 82*b* presses the hammer 50 by virtue of the minute heart contact portion (minute hammer) 57, and the force K2 with which the hour heart 83*b* presses the hammer 50 by virtue of the hour heart contact portion (hour hammer) 58, and the torque the four forces K, K1, K2, and K3 impart to the hammer 50 is also jut in equilibrium; even if the forces with which the peripheral walls of the groove portion 54 and the hole portion 55 support the guide pins 5*d* and 5*c* are not actually exerted, the hammer 50 can be maintained at rest. In this state, the hammer 50 is brought into press contact with the second heart 81*b*, the minute heart 82*b*, and the hour heart 83*b* by virtue of the second heart contact portion 56, the minute heart contact portion 57, and the hour heart contact portion 83*b* to zero-restore the second-counting wheel 81, the minute-counting wheel 82, and the hour-counting wheel 83. As a result, self-alignment is attained.

Next, of the chronograph timepiece 1, the start/stop (chronograph coupling) switch structure 100 operated by the start/stop (chronograph coupling) button 16, and the reset switch (zero-restoring) structure 200 operated by the reset (zero-restoring) button 17 will be described in more detail. In the following, for the sake of convenience in illustration, it will be assumed that a three-dimensional orthogonal coordinate system X, Y, Z is fixed to the main body 8 of the timepiece 1; in this coordinate system, the X-direction corresponds to the 3 o'clock direction, the Y-direction corresponds to the 12 o'clock direction, and the XY-plane is a plane parallel to the main surface of the timepiece 1 (e.g., a plane parallel to the dial, etc.), with the Z-direction being oriented from the case back side to the dial side along the thickness direction.

The chronograph coupling switch structure 100 is composed of a chronograph coupling elastic switch lever portion 110 and a chronograph coupling rigid support lever 150 that are substantially formed in a portion 61 of an outer peripheral edge portion of a plate-like main body portion 60*a* of the battery positive terminal 60 as the terminal plate facing the 1 o'clock to 2 o'clock region.

Similarly, the zero-restoring switch structure 200 is composed of a zero-restoring elastic switch lever portion 210 and a zero-restoring rigid support lever 250 that are substantially formed in a portion 62 of the outer peripheral edge portion of the plate-like main body portion 60*a* of the battery positive terminal 60 as the terminal plate facing the 4 o'clock to 5 o'clock region.

The chronograph coupling elastic switch lever portion 110 has a chronograph coupling arm portion 120 and a chronograph coupling elastic contact portion 130.

One side 122 of a proximal end portion 121 of the chronograph coupling arm portion 120 is substantially connected to the 1 o'clock portion 61*a* of the outer peripheral edge portion of the plate-like main body portion 60*a*, and the one side 122 of the proximal end portion 121 thereof is bent in a direction Ns with respect to the portion 61*a* of the plate-like main body portion 60*a*, and extends from the proximal end portion 121 in a direction Ls along a plane (plane extending in the Z-direction) crossing an extension plane (plane parallel to the XY-plane) of the main body portion 60*a* and along the outer peripheral edge portion of the plate-like main body portion 60*a*; further, it has at the distal end side thereof a pressing force receiving portion 125. When the chronograph coupling button 16 is pushed-in in the direction A1, the distal end portion 16*a* of the chronograph coupling button 16 abuts the pressing force receiving portion 125 of the chronograph coupling arm portion 120, and the pressing force receiving portion receives a pressing force in the direction A1 by the distal end portion 16*a*.

The chronograph coupling elastic contact portion 130 further extends from the pressing force receiving portion 125 of the chronograph coupling arm portion 120, and is equipped with an elastic curved arm portion 131 curved into a U-shape, and a chronograph coupling contact main body 135 formed at the distal end portion 132 of the arm portion 131. As seen in the thickness direction T (i.e., the Z-direction) of the timepiece main body 8, the chronograph coupling contact main body 135 faces a chronograph coupling contact 67 at a height position facing the end edge of a flexible board 66 (See, for example, FIG. 1).

Similarly, the zero-restoring elastic switch lever portion 210 has a zero-restoring arm portion 220 and a zero-restoring elastic contact portion 230.

One side 222 of a proximal end portion 221 of the zero-restoring arm portion 220 is substantially connected with the 5 o'clock portion 62*a* of the outer peripheral edge portion of the plate-like main body portion 60*a*, and the one side 222 of the proximal end portion 221 thereof is bent in a direction Nr with respect to the portion 62*a* of the plate-like main body portion 60*a*, and extends from the proximal end portion 221 in a direction Lr along a plane (plane extending in the Z-direction) crossing an extension plane (plane parallel to the XY-plane) of the main body portion 60*a* and along the outer peripheral edge portion of the plate-like main body portion 60*a*; further, it has at the distal end side thereof a pressing force receiving portion 225. When the zero-restoring button 17 is pushed-in in the direction D1, the distal end portion 17*a* of the zero-restoring button 17 abuts the pressing force receiving portion 225 of the zero-restoring arm portion 220, and the pressing force receiving portion receives a pressing force in the direction D1 by the distal end portion 17*a*.

The zero-restoring elastic contact portion 230 further extends from the pressing force receiving portion 225 of the zero-restoring arm portion 220, and is equipped with an elastic curved arm portion 231 curved into a U-shape, and a zero-restoring contact main body 235 formed at the distal end portion 232 of the arm portion 231. As seen in the thickness direction T (i.e., the Z-direction) of the timepiece main body 8, the zero-restoring contact main body 235 faces a zero-restoring contact 68 at a height position facing the end edge of the flexible board 66 (See FIGS. 7 and 1).

Figure 8:
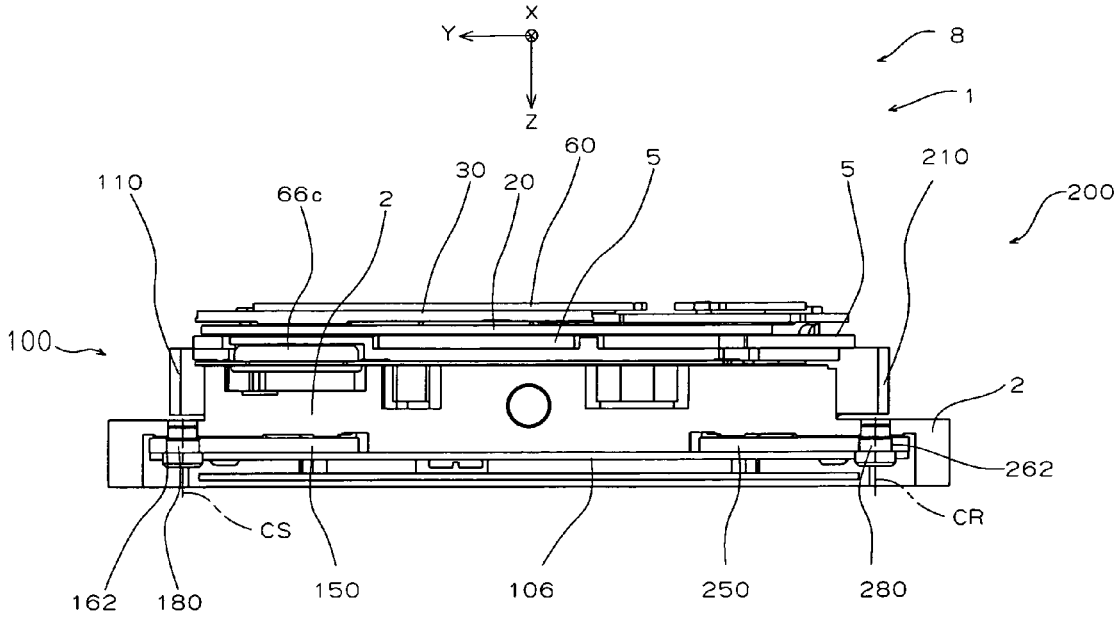
FIG. 8 shows an enlarged explanatory view, partly in section, of a portion mainly related to the rotational support of the switch lever portion support lever by the main plate.

As can be seen from FIGS. 2, 6, and 8 in addition to FIG. 1, the chronograph coupling rigid support lever 150 has a rigid substrate portion 160 extending parallel to the XY-plane, and a rigid support wall portion 170 supporting the pressing force receiving portion 125 behind the pressing force receiving portion 125 of the chronograph coupling arm portion 120 of the chronograph coupling elastic switch lever 110. As can be seen from FIGS. 6 and 8, the rigid substrate portion 160 has a substantially "V"-shaped planar configuration, and is rotatably supported by a pin-like rotation center shaft 180 at a hole portion 162 of a proximal end portion 163 of a proximal end side leg portion 161 constituting one leg portion of the "V"-shape. A distal end side leg portion 164 constituting the other leg portion of the "V"-shape of the rigid substrate portion 160 extends substantially radially outwards, and is bent in the thickness direction Z of the timepiece main body 8 at a distal end portion 165 to be continuously connected with the rigid support wall portion 170.

Figure 3:
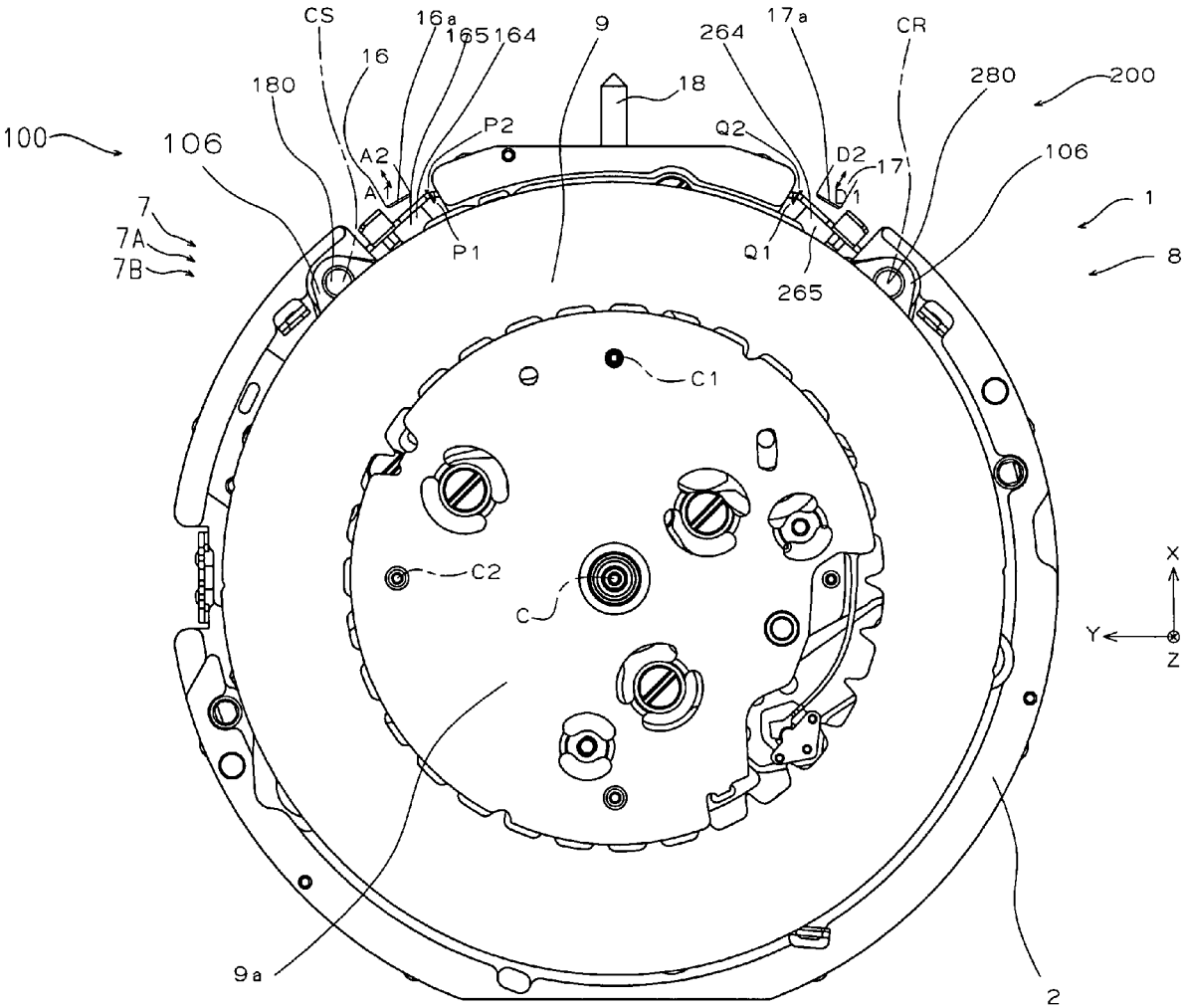
FIG. 3 shows an explanatory plan view, as seen from the dial side, of the main body portion of the electronic timepiece of FIG. 1.

As can be seen from FIGS. 3 and 6 and FIG. 2, the rotation center CS of the rotation center shaft 180 of the chronograph coupling rigid support lever 150 overlaps, as seen in the Z-direction, the chronograph coupling arm portion 120 of the chronograph coupling elastic switch lever portion 110 and is at a position corresponding to ⅓ of the chronograph coupling arm portion 120. Instead of being strictly ⅓, it may be somewhat deviated to the distal end side or the proximal end side.

As can be seen from FIGS. 2, 6, 7 and 8 in addition to FIG. 1, the zero-restoring rigid support lever 250 has a rigid substrate portion 260 extending parallel to the XY-plane, and a rigid support wall portion 270 supporting the pressing force receiving portion 225 behind the pressing force receiving portion 225 of the zero-restoring arm portion 220 of the zero-restoring elastic switch lever 210. As can be seen from FIGS. 6 and 8, the rigid substrate portion 260 also has a substantially "V"-shaped planar configuration, and is rotatably supported by a pin-like rotation center shaft 280 at a hole portion 262 of a proximal end portion 263 of a proximal end side leg portion 261 constituting one leg portion of the "V"-shape. A distal end side leg portion 264 constituting the other leg portion of the "V"-shape of the rigid substrate portion 260 extends substantially radially outwards, and is bent in the thickness direction Z of the timepiece main body 8 at a distal end portion 265 to be continuously connected with the rigid support wall portion 270.

Similarly, as can be seen from FIGS. 3 and 6 and FIG. 2, the rotation center CR of the rotation center shaft 180 of the zero-restoring rigid support lever 250 also overlaps, as seen in the Z-direction, the zero-restoring arm portion 220 of the zero-restoring elastic switch lever portion 210 and is at a position corresponding to ⅓ of the zero-restoring arm portion 220. Instead of being strictly ⅓, it may be somewhat deviated to the distal end side or the proximal end side.

In FIGS. 3 and 8, numeral 106 indicates a support lever holder, and, in FIG. 3, numeral 9 indicates a date indicator, and numeral 9*a* indicates a date indicator maintaining plate.

Figure 4:
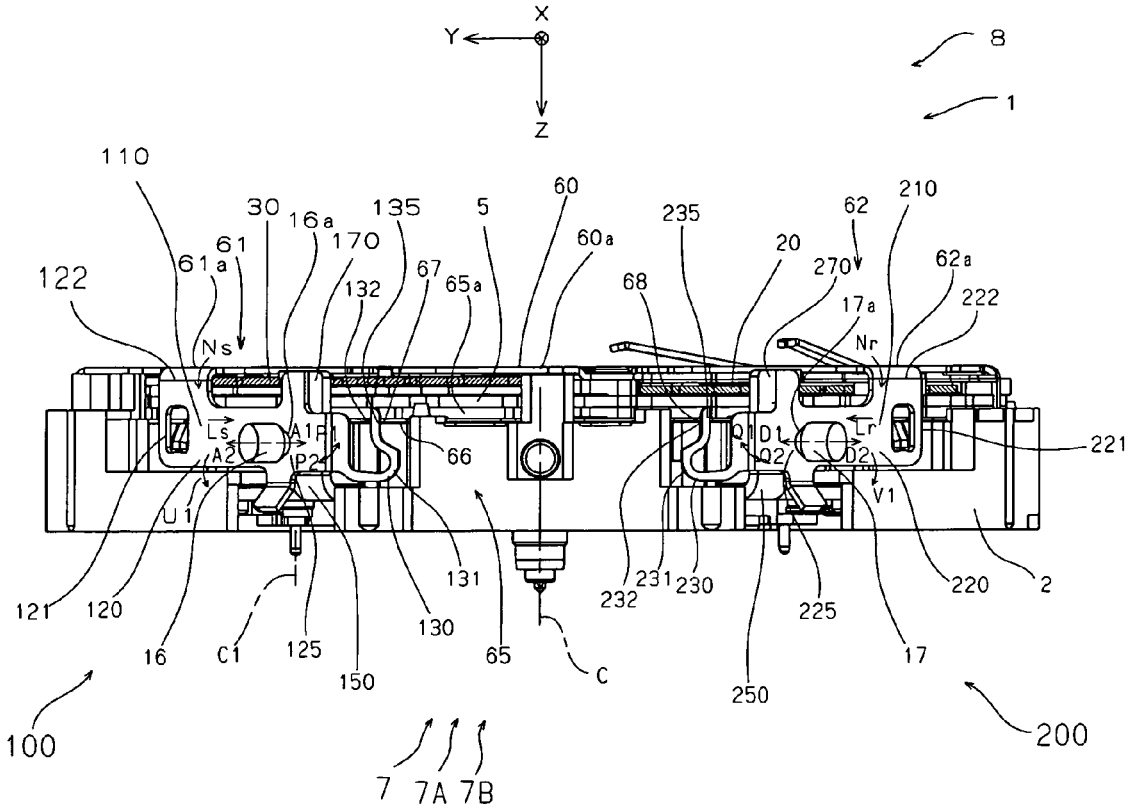
FIG. 4 shows an explanatory side view, as seen from the winding stem side in the direction of the arrow IV, of the electronic timepiece of FIG. 1.
Figure 7:
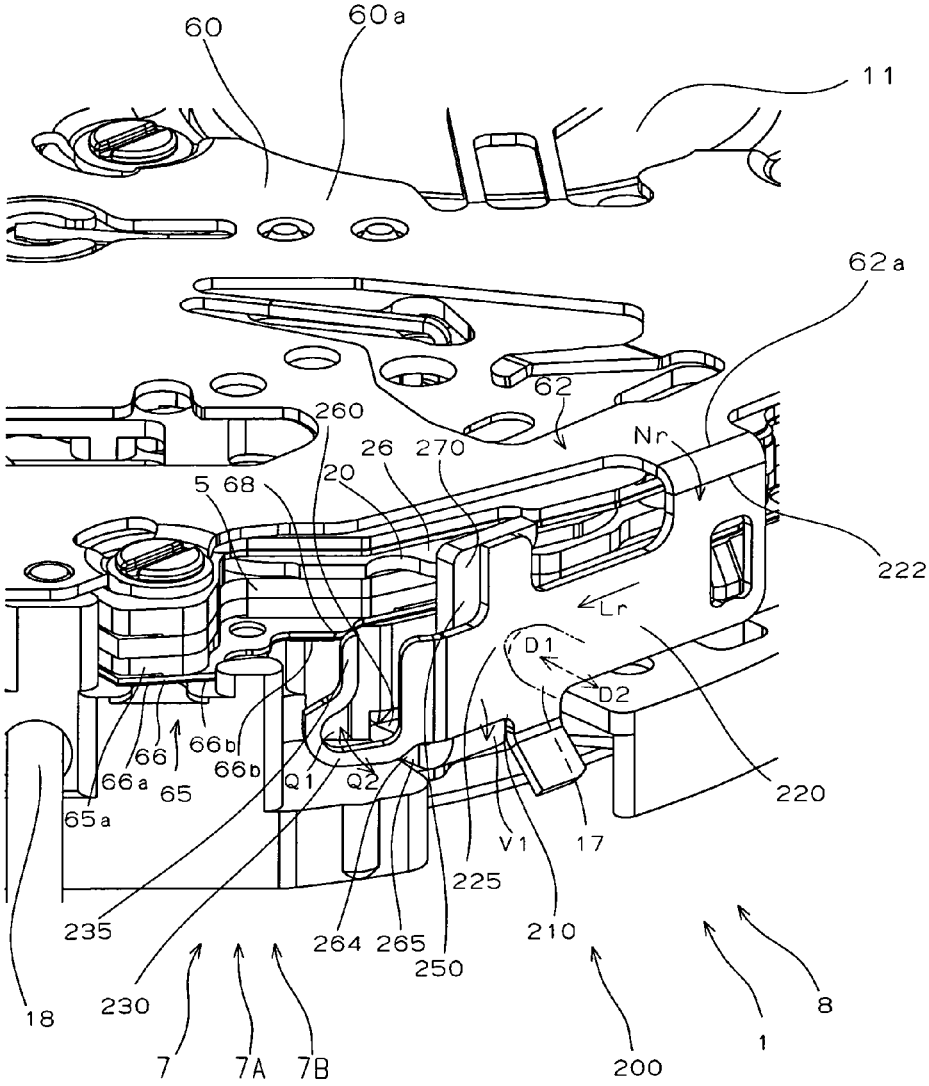
FIG. 7 shows an enlarged explanatory perspective view of a switch structure portion of the main body portion of the electronic timepiece of FIG. 1.

Next, the operation of the chronograph coupling switch structure 100 and the zero-restoring switch structure 200 constructed as described above will be described with reference to the plan views (or bottom views) of FIGS. 2 and 3 and FIGS. 5 and 6 in addition to the perspective view, etc. of FIGS. 1, 4, and 7.

When the chronograph coupling button 16 is pushed-in in the direction A1 by the user of the chronograph timepiece 1, the distal end portion 16*a* of the chronograph coupling button 16 abuts the pressing force receiving portion 125 of the chronograph coupling arm portion 120 of the chronograph coupling elastic switch lever portion 110 of the chronograph coupling switch structure 100 to push in the pressing force receiving portion 125 in the direction A1. Thus, the distal end side portion of the chronograph coupling arm portion 120 extending in the direction Ls with respect to the proximal end portion 121 is rocked in the direction P1 (FIG. 2, etc.) with respect to the proximal end portion 121. As a result, the chronograph coupling contact main body 135 at the distal end portion 132 of the U-shaped elastic curved arm portion 131 of the chronograph coupling elastic contact portion 130 situated at the distal end side of the chronograph coupling arm portion 120 is also rocked substantially in the direction P1, and is pressed against the chronograph coupling contact 67 of the flexible board 66, whereby a predetermined electric chronograph coupling signal S1 is generated. The contact main body 135 is situated at the distal end portion 132 of the U-shaped elastic curved arm portion 131, so that it is pressed against the chronograph coupling contact 67 of the flexible board 66 in a relatively stable manner with an appropriate strength, and there is little fear of the pressing force being excessively small or excessively large.

In this chronograph timepiece 1, the chronograph coupling arm portion 120 is bent at one side portion 122 of the proximal end portion 121 to be connected with the outer peripheral edge portion 61*a* of the plate-like main body portion 60*a*, and the pressing force receiving portion 125 is deviated in the +Z direction from the one side portion 122 to be situated close to the case back of the timepiece 1, so that, assuming that there is no chronograph coupling rigid support lever 150, the chronograph coupling arm portion 120 is more or less curved in the direction U1 (direction of rotation around a rotation axis extending in a plane parallel to the XY-plane) in response to the depression in the direction A1 of the pressing force receiving portion 125 by the chronograph coupling button 16. Further, the chronograph coupling contact main portion 135 of the chronograph coupling elastic contact portion 130 is situated at a position in the Z-direction different from that of the pressing force receiving portion 125 of the chronograph coupling arm portion 120 (a different position in the thickness direction T of the timepiece 1 or the timepiece main body 8), so that when deflection in the direction U1 is generated in the chronograph coupling arm portion 120, there is generated a deviation between the pressing-in amount (length) in the direction A1 of the pressing force receiving portion 125 and the pressing-in amount (length) by which the chronograph coupling contact main body portion 135 is pushed in toward the chronograph coupling contact 67 of the circuit block 65 (The deviation from the displacement corresponding to the arm length ratio in the direction Ls increases). Thus, it becomes difficult for an appropriate electrical contact between the chronograph coupling contact main body portion 135 and the chronograph coupling contact 67 to be effected, and there is a fear of the predetermined chronograph coupling signal S1 not being properly generated.

However, in this chronograph coupling switch structure 100, the rigid support wall portion 170 of the chronograph coupling rigid support lever 150 is situated behind (radially on the inner side of) the elastic arm portion 120 of the chronograph coupling elastic switch lever portion 110, so that the curving in the direction U1 of the elastic arm portion 120 can be suppressed to a minimum; thus, the contact main body 135 of the chronograph coupling elastic contact portion 130 is displaced toward the corresponding chronograph coupling contact 67 and can be pressed against the same with a predetermined pressing force according to the pushing-in amount in the direction A1 with respect to the pressing force receiving portion 125 in response to the pushing-in in the direction A1 of the chronograph coupling button 16 regardless of the magnitude of the difference in position in the Z-direction.

The chronograph coupling rigid support lever 150 is substantially supported by the main plate 2 or the like so as to be rotatable around the rotation center CS (FIGS. 3, 2, 8, etc.) situated at a position corresponding to ⅓ of the length of the arm portion 120, so that the support wall portion 170 of the chronograph coupling rigid support lever 150 can be rotated around the center axis CS so as to be substantially in conformity with the curving of the elastic arm portion 120. As a result, regardless of the curving state of the arm portion 120, the arm portion 120 can practically always be supported by the support wall portion 170 of the chronograph coupling rigid support lever 150.

Similarly, when the zero-restoring button 17 is pushed-in in the direction D1, the distal end portion 17*a* of the zero-restoring portion 17 abuts the pressing force receiving portion 225 of the zero-restoring arm portion 220 of the zero-restoring elastic switch lever portion 210 of the zero-restoring switch structure 200 to push in the pressing force receiving portion 225 in the direction D1. Thus, the distal end side portion of the zero-restoring arm portion 220 extending in the direction Lr with respect to the proximal end portion 221 is rocked in the direction Fr1 with respect to the proximal end portion 221. As a result, the zero-restoring contact main body 235 at the distal end portion 232 of the U-shaped elastic curved arm portion 231 of the zero-restoring elastic contact portion 230 situated at the distal end side of the zero-restoring arm portion 220 is also substantially rocked in the direction Fr1, and is pressed against the zero-restoring contact 68 of the flexible board 66, and a predetermined electric zero-restoring signal S2 is generated. The contact main body 235 is situated at the distal end portion 232 of the U-shaped elastic curved arm portion 231, so that it is pressed against the zero-restoring contact 68 of the flexible board 66 with an appropriate strength, and there is no fear of the pressing force being excessively small or excessively large.

In this chronograph timepiece 1, the zero-restoring arm portion 220 is bent at one side portion 222 of the proximal end portion 221 to be connected with the outer peripheral edge portion 61*b* of the plate-like main body portion 60*a*, and the pressing force receiving portion 225 is deviated in the +Z direction from the one side portion 222 to be situated close to the case back of the timepiece 1, so that, assuming that there is no zero-restoring rigid support lever 250, the zero-restoring arm portion 220 is more or less curved in the direction Fr2 (direction of rotation around a rotation axis extending in a plane parallel to the XY-plane) in response to the pushing-in in the direction D1 of the pressing force receiving portion 225 by the zero-restoring button 17. Further, the zero-restoring contact main portion 235 of the zero-restoring elastic contact portion 230 is situated at a position in the Z-direction different from that of the pressing force receiving portion 225 of the zero-restoring arm portion 220 (a different position in the thickness direction T of the timepiece 1 or the timepiece main body 8), so that when deflection in the direction Fr2 is generated in the zero-restoring arm portion 220, there is generated a deviation between the pressing-in amount (length) in the direction D1 of the pressing force receiving portion 225 and the pressing-in amount (length) by which the zero-restoring contact main body portion 235 is pushed in toward the zero-restoring contact 68 of the circuit block 65 (The deviation from the displacement corresponding to the arm length ratio in the direction Lr increases). Thus, it becomes difficult for an appropriate electrical contact between the zero-restoring contact main body portion 235 and the zero-restoring contact 68 to be effected, and there is a fear of the predetermined zero-restoring signal S2 not being properly generated.

However, in this zero-restoring switch structure 200, the rigid support wall portion 270 of the zero-restoring rigid support lever 250 is situated behind (radially on the inner side of) the elastic arm portion 220 of the zero-restoring switch lever portion 210, so that the curving in the direction Fr2 of the elastic arm portion 220 can be suppressed to a minimum; thus, the contact main body 235 of the zero-restoring elastic contact portion 230 is displaced toward the corresponding zero-restoring contact 68 and can be pressed against the same with a predetermined pressing force according to the pushing-in amount in the direction D1 with respect to the pressing force receiving portion 225 in response to the pushing-in in the direction D1 of the zero-restoring button 17 regardless of the magnitude of the difference in position in the Z-direction.

The zero-restoring rigid support lever 250 is substantially supported by the main plate 2 or the like so as to be rotatable around the rotation center CR (FIGS. 3, 2, 8, etc.) situated at a position corresponding to ⅓ of the length of the arm portion 220, so that the support wall portion 270 of the zero-restoring rigid support lever 250 can be rotated around the center axis CR so as to be substantially in conformity with the curving of the elastic arm portion 220. As a result, regardless of the curving state of the arm portion 220, the arm portion 220 can practically always be supported by the support wall portion 270 of the chronograph coupling rigid support lever 250.

Next, the operation of the chronograph timepiece 1, constructed as described above, will be briefly described.

As shown in FIG. 5, in the initial state of the chronograph mechanism 7B of the main body (movement) 8 of the chronograph timepiece 1, the zero-restoring instruction lever 20 is rotationally biased in the direction F2 under the action of the spring 24 and assumes the initial position where it is locked by the lock pin 5*f* at the lock edge portion 28. At this initial position, the stop lever locking protrusion 27 of the zero-restoring instruction lever 20 presses the locked portion 76 of the stop lever 70 to set the stop lever 70 at a position where it has been rotated in the direction M2 against the spring force of the spring 74. Further, in the initial state of the chronograph mechanism 7, the pin-like protrusion 38 of the chronograph coupling lever 30 is biased in the direction F1 by the shoulder portion 63*e* of the chronograph coupling switch spring portion 63 and assumes the initial position where it is locked by the lock protrusion 2*g* of the main plate 2 at the locked portion 39 at the outer edge of the end portion 34. Further, in the initial state of the chronograph mechanism 7B, the hammer operating lever 40 assumes the operating position where it has been rotated to a maximum in the direction H1. At this operating position, the pin-like protrusion 47 is engaged with the proximal end side inclined portion of the protrusion 64*e* of the hammer operating lever switch spring portion 64, and the hammer operating portion 49 is set at the zero-restoring position where the hammer 50 has been displaced to a maximum degree in the direction J1. That is, at the zero-restoring position, the hammers 56, 57, and 58 of the hammer 50 are held in press contact with the corresponding hearts 81*b*, 82*b*, and 83*b* to set the hearts 81*b*, 82*b*, and 83*b* at the zero-restoring positions.

In this initial state, when the chronograph coupling (start/stop) button 16 is depressed in the direction A1, the pressing force receiving portion 125 of the arm portion 120 of the chronograph coupling elastic switch lever portion 110 of the chronograph coupling switch structure 100 is pushed-in in the direction A1 by the distal end portion 16*a* of the chronograph coupling button 16, and the arm portion 120 of the chronograph coupling elastic switch lever portion 110 presses the protrusion 36 of the chronograph coupling lever 30 via the support wall portion 170 of the chronograph coupling rigid support lever 150 behind; further, the contact main body portion 135 of the chronograph coupling elastic contact portion 130 at the distal end is pressed against the chronograph coupling contact 67 of the circuit block 65 with an appropriate pressing force, and the contacts 135 and 67 are brought into electrical contact with each other to turn the contact ON, issuing the chronograph measurement start signal S1 to start the driving of the chronograph hand movement motor 13; when there is a counter (not shown), measurement by the counter is started.

On the other hand, the chronograph coupling lever 30 whose protrusion 36 has received the depression force in the direction A1 of the chronograph coupling button 16 is rotated in the direction F2, and, with this rotation in the direction F2, the pin-like protrusion 38 of the chronograph coupling lever 30 is detached from the shoulder portion 63*e* of the switch spring portion 63 and is displaced along the proximal end side long side surface; at this time, the operator can get a click feel with respect to the depression force in the direction A1 of the chronograph coupling button 16. With the rotation in the direction F2 of the chronograph coupling lever 30, the chronograph coupling lever 30 reaches the operating position.

This operating position is the position when the chronograph coupling button 16 is pushed-in in the direction A1 beyond a predetermined range (so as to release the lock of the hearts); for example, it may be a maximum pushing-in position or a position in the vicinity thereof. With the rotation in the direction F2 of the chronograph coupling lever 30, the chronograph coupling lever engagement portion 44 of the hammer operating lever 40, which has been at the initial position, receives a pressing force in the direction F2 by the protrusion 35 of the chronograph coupling lever 30 to be rotated in the direction H2, and the pin-like protrusion 47 of the hammer operating lever 40 gets over the apex of the protrusion 64*e* of the switch spring portion 64 to move from the proximal end side inclined surface to the distal end side inclined surface. (When the pin-like protrusion 47 gets over the apex, the operator can get a second click feel). After this, the hammer operating lever 40 receives a rotational force in the direction H2 by the spring portion 64. As a result, even when the chronograph coupling lever engagement portion 44 of the hammer operating lever 40 is detached from the protrusion 35 of the chronograph coupling lever 30, the pin-like protrusion 47 is further rotated in the direction H2; when the pin-like protrusion 47 reaches the bottom of the recess 64*f*, the rotation in the direction H2 of the hammer operating lever 40 is completed, and the hammer operating lever 40 assumes the initial position. Further, as the hammer operating lever 40 is rotated in the direction H2 from the operating position to the initial position, the hammer 50 the operating pin 51 of which is engaged with the hammer operating portion 49 of the hammer operating lever 40 is also returned from the operating position (zero-restoring position) to the initial position (open position), and the hammers 56, 57, and 48 completely release the setting of the hearts 81*b*, 82*b*, and 83*b*. Thus, the hand movement of the chronograph hands 81*a*, 82*a*, and 83*a* accompanying the chronograph measurement is started.

In this state, there is a gap between the chronograph coupling lever engagement portion 44 of the hammer operating lever 40 and the protrusion 35 of the chronograph coupling lever 30, so that, even if, for example, a shock in the direction A1 is applied to the chronograph coupling button 16, there is no fear of the shock being transmitted to the other levers, etc., and there is little fear of the chronograph mechanism 7B being damaged.

Next, when the depression in the direction A1 of the chronograph coupling button 16 is released, the timepiece is placed in a chronograph measurement state. In this chronograph measurement state, the chronograph coupling elastic switch lever portion 110 is returned in the direction P2 by the restoring force of the chronograph coupling elastic switch lever 110 of the chronograph coupling switch structure 100, and the chronograph coupling button 16 is also restored to the protruding position in the direction A2. Due to the restoring force in the direction G2 of the switch spring portion 63, the chronograph coupling lever 30 is also pushed back, and is rotated in the direction F1 to be returned to the initial position where the locked portion 39 is locked by the lock protrusion 2*g*.

When the chronograph coupling button 16 is depressed during the chronograph measurement, the chronograph coupling elastic switch lever portion 110 of the chronograph coupling switch structure 100 is rocked in the direction P1 with the depression in the direction A1 of the chronograph coupling button 16, and the switch contact is turned ON to issue the stop signal S1 as the chronograph coupling signal, stopping the chronograph hand movement motor 13. On the other hand, in response to the rotation in the direction F2 of the chronograph coupling lever 30 in accordance with the rotation of the chronograph coupling rigid support lever 150 of the switch structure 100 accompanying the depression in the direction A1 of the chronograph coupling button 16, the switch spring portion 63 is rocked in the direction G1, imparting a click feel when the shoulder portion 63*e* is got over; when the switch spring portion 63 is returned in the direction G2, the chronograph coupling lever 30 is returned in the direction F1.

When the chronograph coupling button 16 is depressed again while the chronograph measurement is at rest, the chronograph coupling elastic switch lever portion 110 of the chronograph coupling switch structure 100 is rocked in the direction B1 with the depression in the direction A1 of the chronograph coupling button 16 to turn ON the switch contact, issuing a restart signal S1 as the chronograph coupling signal, whereby the driving of the chronograph hand movement motor 13 is (again) started. On the other hand, in response to the rotation in the direction F2 of the chronograph coupling lever 30 in accordance with the rotation of the chronograph coupling rigid support lever 150 of the chronograph coupling switch structure 100 accompanying the depression in the direction A1 of the chronograph coupling button 16, the switch spring portion 63 is rocked in the direction G1, imparting a click feel when the shoulder portion 63*e* is got over; when the switch spring portion 63 is returned in the direction G2, the chronograph coupling lever 30 is returned in the direction F1.

The above stopping and restarting of the chronograph mechanism 7 is repeated in response to the depression of the chronograph coupling button 16 and the releasing thereof.

In the chronograph measurement stop state or the chronograph measurement state, when the reset (zero-restoring) button 17 is depressed in the direction D1 to issue a chronograph zero-restoring instruction, as the reset button 17 is depressed in the direction D1, the pressing force receiving portion 225 of the arm portion 220 of the zero-restoring elastic switch lever portion 210 of the zero-restoring switch structure 200 is pushed-in in the direction D1 by the distal end portion 17*a* of the zero-restoring button 16, and the arm portion 220 of the zero-restoring elastic switch lever portion 210 presses the protrusion 26 of the zero-restoring instruction lever 20 via the support wall portion 270 of the zero-restoring rigid support lever 250 behind; at the same time, the contact main body portion 235 of the distal end zero-restoring elastic contact portion 230 is pressed against the zero-restoring contact 68 of the circuit block 65 with an appropriate pressing force, and the contacts 235 and 65 are brought into electrical contact with each other to turn ON the contacts, issuing the chronograph zero-restoring instruction signal S2 (In the case where chronograph measurement has been conducted also by a timer counter or the like, that time counter is reset).

On the other hand, with the depression in the direction D1 of the zero-restoring button 17, the zero-restoring instruction lever 20 whose instruction receiving protrusion 26 receives a pressing force via the support wall portion 270 of the zero-restoring rigid support lever 250 is rotated in the direction F1. When the rotation in the direction F1 of the zero-restoring instruction lever 20 is started, the lock protrusion 27 of the zero-restoring instruction lever 20 is quickly detached from the locked portion 76 of the stop lever 70 to release the lock of the stop lever 70, so that the stop lever 70 is rotated in the direction M1 under the action of the spring 74 to reach an operating position P7*a*, and a setting edge portion 78 is pressed against the second counter second intermediate wheel 84*b* to set the second counter second intermediate wheel 84*b*, stopping the rotation of the second-counting wheel 81. When the zero-restoring instruction lever 20 is further rotated in the direction F1, the engagement edge portion 29 of the zero-restoring instruction lever 20 is engaged with the pin-like protrusion 45 of the hammer operating lever 40, and rotates the hammer operating lever 40, which has been at the initial position, in the direction H1 via the pin-like protrusion 45. As the hammer operating lever 40 rotates in the direction H1, the pin-like protrusion 47 moves from the recess 64*f* to the proximal end side inclined portion, getting over the apex of the protrusion 64*e*. When the pin-like protrusion 47 gets over the protrusion 64*e*, even if the pin-like protrusion 45 of the hammer operating lever 40 is detached from the engagement edge portion 29 of the zero-restoring instruction lever 20, the hammer operating lever 40 is rotated in the direction H1 by the spring force of the switch spring portion 64. Thus, the resistance to the depression of the zero-restoring button 17 is abruptly reduced, and the operator can experience a click feel. As the hammer operating lever 40 rotates in the direction H1, the hammer operating lever operating portion 49 of the hammer operating lever 40 presses the hammer 50 in the direction K via the operating pin 51. The movement in the direction J1 of the hammer 50 is guided by the groove portion 52 and the hole portion 53 with which the guide pins 5*d* and 5*c* are engaged; in particular, orientation and position adjustment is made by enlarged diameter portions 54 and 55 (i.e., self-alignment is effected), whereby forcible zero-restoring of the hearts 81*b*, 82*b*, and 83*b* is effected by the hammers 56, 57, and 58. As a result, the hammer operating lever 40 reaches the operating position, and the hammer 50 also reaches the operating position.

In this state, the zero-restoring button 17 is pushed-in in the direction D1 to a maximum degree, and if the zero-restoring instruction lever 20 is rotated to a maximum degree in the direction F1, there remains a gap between the engagement edge portion 29 of the zero-restoring instruction lever 20 and the pin-like protrusion 45 of the hammer operating lever 40, so that even if an inadvertent shock in the direction D1 is applied to the zero-restoring button 17, there is little fear of the shock being directly transmitted to the other train wheels, etc.

Next, when the depression of the reset button 17 is released, the zero-restoring elastic switch lever portion 210 is returned in the direction Fr3 by the restoring force of the zero-restoring elastic switch lever portion 210 of the zero-restoring switch structure 200, and the zero-restoring button 16 is also restored to the protruding position in the direction D2. As the zero-restoring elastic switch lever portion 210 is returned in the direction Fr3, under the action of the spring 24, the zero-restoring instruction lever 20 is restored to the initial position where the lock edge portion 28 is locked by the lock pin 5*f*. As a result, the lock protrusion 27 of the zero-restoring instruction lever 20 again abuts the locked portion 76 of the stop lever 70 to restore the stop lever 70 to the initial position, and releases the setting of the second counter second intermediate wheel 84*b*. However, the hearts 81*b*, 82*b*, and 83*b* remain forcibly zero-restored by the hammers 56, 57, and 58, and the chronograph hand movement motor 13 remains at rest.

Figure 12:
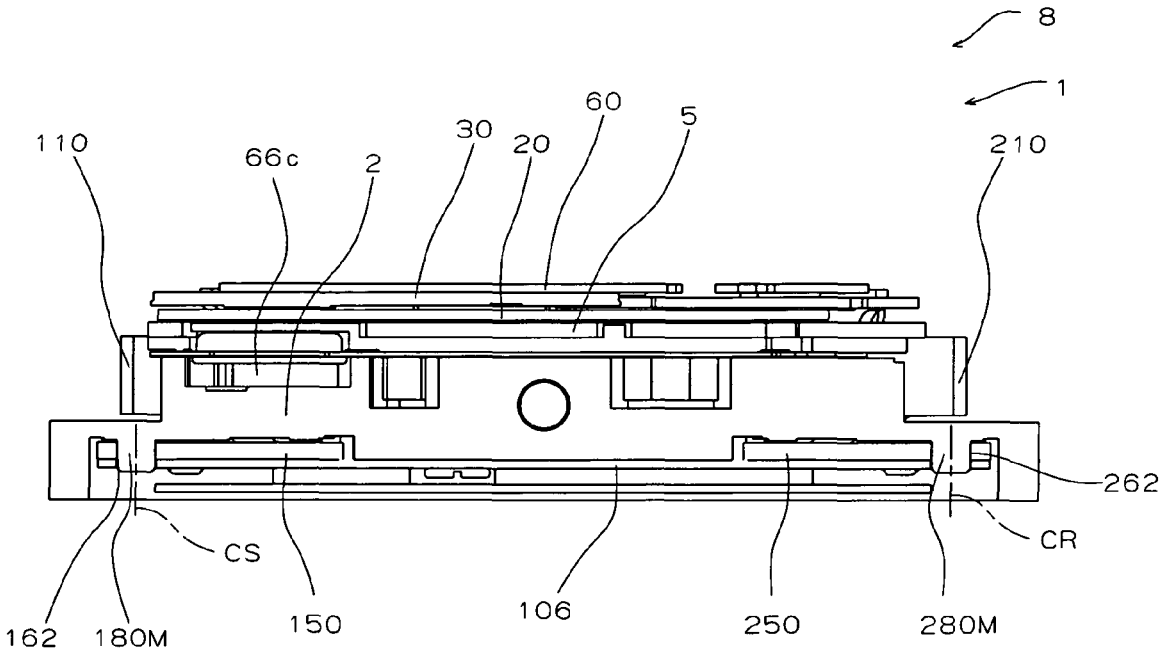
FIG. 12 shows an explanatory view, partly in section and enlarged as in the case of FIG. 8, of a portion related to the rotational support of the switch lever portion support lever by the main plate of the main body portion of the electronic timepiece of FIG. 1 according to a modification of the example of FIG. 8.

While in the above-described example the pin 180, 280 fitted to the rigid support lever 150, 250 and integral with the rigid support lever 150, 250 is rotatably fit-engaged with the main plate 2, so long as the rigid support lever 150, 250 is supported so as to be rotatable around the center axis CS, CR with respect to the stationary support substrate of the timepiece main body 8 such as the main plate 2, it is also possible, as shown, for example, in FIG. 12, to provide a protrusion 180M, 280M integral with the main plate 2, and to rotatably fit-engage the protrusion 180M, 280M with a through-hole 162, 262 of the support lever 150, 250.

Further, while the rigid support lever 150, 250 has been described to be as if simply rotatable around the center axis CS, CR, the rigid support lever 150, 250 may be spring-loaded so as to assume a position where it is biased in one direction. In this case, the spring may be a spiral spring or some other type of spring. Further, typically, the rigid support lever 150, 250 is determined in rotational area in both directions, and is rotatable between a rotating position at one end and a rotating position at the other end. However, if so desired, it is also possible for the rotatable range to be not regulated.

Further, while in the above-described example the mechanical chronograph mechanism 7B of the chronograph mechanism 7 is endowed with a specific structure, the mechanical chronograph mechanism 7B, to which the switch structure 100, 200 constituting the electric (electronic) chronograph mechanism 7A of the chronograph mechanism 7 is applied, is not restricted to the one as shown in the drawings but may also be of some other structure.

What is claimed is:

1. A switch structure comprising:

a terminal plate having a main body portion and a plurality of elastic switch lever portions, each of the elastic switch lever portions having an arm portion and an elastic contact portion, the arm portion having a proximal end portion, a distal end and a pressing force receiving portion at the distal end for receiving a pressing force and from which the elastic contact portion extends, the arm portion being connected to an outer peripheral edge portion of the main body portion at one side of the proximal end portion and being bent with respect to the outer peripheral edge portion at the one side of the proximal end portion, and the arm portion extending from the proximal end portion along an extension surface of the main body portion in a direction along the outer peripheral edge portion of the main body portion; and a plurality of rigid support levers movably provided relative to respective ones of the pressing force receiving portions of the elastic switch lever portions, each of the rigid support levers having a rigid substrate portion and a rigid support wall portion that is connected to a distal end of the rigid substrate portion and that supports the corresponding pressing force receiving portion so as to receive a pressing force from the corresponding pressing force receiving portion and to guide displacement of the corresponding pressing force receiving portion when a pressing force is applied to the corresponding pressing force receiving portion.

2. A switch structure according to claim 1, wherein each of the rigid support levers is rotatably supported.

3. A switch structure according to claim 2, wherein each of the rigid support levers is bent in a direction opposite to the corresponding arm portion of the elastic switch lever portion.

4. A switch structure according to claim 3, wherein the elastic contact portion of each elastic switch lever portion has an elastic curved arm portion curved into a U-shape.

5. A chronograph mechanism comprising: a switch structure according to claim 4; a start/stop button and a reset button configured to exert a pressing force to respective ones of the pressing force receiving portions of the switch structure; a chronograph indication hand for performing a time measuring operation; a chronograph coupling lever mounted to undergo rotation in response to depression of the start/stop button to start or stop a time measuring operation of the chronograph indication hand; and a zero-restoring instruction lever mounted to undergo rotation in response to depression of the reset button to restore the chronograph indication hand to zero.

6. A chronograph mechanism comprising: a switch structure according to claim 3; a start/stop button and a reset button configured to exert a pressing force to respective ones of the pressing force receiving portions of the switch structure; a chronograph indication hand for performing a time measuring operation; a chronograph coupling lever mounted to undergo rotation in response to depression of the start/stop button to start or stop a time measuring operation of the chronograph indication hand; and a zero-restoring instruction lever mounted to undergo rotation in response to depression of the reset button to restore the chronograph indication hand to zero.

7. A switch structure according to claim 2, wherein the elastic contact portion of each elastic switch lever portion has an elastic curved arm portion curved into a U-shape.

8. A chronograph mechanism comprising: a switch structure according to claim 7; a start/stop button and a reset button configured to exert a pressing force to respective ones of the pressing force receiving portions of the switch structure; a chronograph indication hand for performing a time measuring operation; a chronograph coupling lever mounted to undergo rotation in response to depression of the start/stop button to start or stop a time measuring operation of the chronograph indication hand; and a zero-restoring instruction lever mounted to undergo rotation in response to depression of the reset button to restore the chronograph indication hand to zero.

9. A chronograph mechanism comprising: a switch structure according to claim 2; a start/stop button and a reset button configured to exert a pressing force to respective ones of the pressing force receiving portions of the switch structure; a chronograph indication hand for performing a time measuring operation; a chronograph coupling lever mounted to undergo rotation in response to depression of the start/stop button to start or stop a time measuring operation of the chronograph indication hand; and a zero-restoring instruction lever mounted to undergo rotation in response to depression of the reset button to restore the chronograph indication hand to zero.

10. A chronograph mechanism according to claim 9, further comprising a hammer configured to forcibly and mechanically restore the chronograph indication hand to zero as the zero-restoring instruction lever rotates.

11. A switch structure according to claim 1, wherein each of the rigid support levers is bent in a direction opposite to the corresponding arm portion of the elastic switch lever portion.

12. A switch structure according to claim 11, wherein the elastic contact portion of each elastic switch lever portion has an elastic curved arm portion curved into a U-shape.

13. A chronograph mechanism comprising: a switch structure according to claim 12; a start/stop button and a reset button configured to exert a pressing force to respective ones of the pressing force receiving portions of the switch structure; a chronograph indication hand for performing a time measuring operation; a chronograph coupling lever mounted to undergo rotation in response to depression of the start/stop button to start or stop a time measuring operation of the chronograph indication hand; and a zero-restoring instruction lever mounted to undergo rotation in response to depression of the reset button to restore the chronograph indication hand to zero.

14. A chronograph mechanism comprising: a switch structure according to claim 11; a start/stop button and a reset button configured to exert a pressing force to respective ones of the pressing force receiving portions of the switch structure; a chronograph indication hand for performing a time measuring operation; a chronograph coupling lever mounted to undergo rotation in response to depression of the start/stop button to start or stop a time measuring operation of the chronograph indication hand; and a zero-restoring instruction lever mounted to undergo rotation in response to depression of the reset button to restore the chronograph indication hand to zero.

15. A switch structure according to claim 1, wherein the elastic contact portion of each elastic switch lever portion has an elastic curved arm portion curved into a U-shape.

16. A chronograph mechanism comprising: a switch structure according to claim 15; a start/stop button and a reset button configured to exert a pressing force to respective ones of the pressing force receiving portions of the switch structure; a chronograph indication hand for performing a time measuring operation; a chronograph coupling lever mounted to undergo rotation in response to depression of the start/stop button to start or stop a time measuring operation of the chronograph indication hand; and a zero-restoring instruction lever mounted to undergo rotation in response to depression of the reset button to restore the chronograph indication hand to zero.

17. A chronograph mechanism comprising: a switch structure according to claim 1; a start/stop button and a reset button configured to exert a pressing force to respective ones of the pressing force receiving portions of the switch structure; a chronograph indication hand for performing a time measuring operation; a chronograph coupling lever mounted to undergo rotation in response to depression of the start/stop button to start or stop a time measuring operation of the chronograph indication hand; and a zero-restoring instruction lever mounted to undergo rotation in response to depression of the reset button to restore the chronograph indication hand to zero.

18. A chronograph mechanism according to claim 17, further comprising a hammer configured to forcibly and mechanically restore the chronograph indication hand to zero as the zero-restoring instruction lever rotates.

19. An electronic timepiece having a chronograph mechanism as claimed in claim 17.

20. An electronic timepiece having a switch structure as claimed in claim 1.

21. A switch structure according to claim 1, wherein the main body portion of the terminal plate is plate-shaped.

22. A switch structure according to claim 1, wherein the rigid substrate portion of each of the rigid support levers has a substantially V-shaped configuration.

23. A switch structure according to claim 22, wherein each of the rigid substrate portions includes a portion forming a leg portion of the V-shape and having the distal end connected to the rigid support wall portion.

24. A switch structure comprising:

a terminal plate having a main body portion;

an elastic switch lever portion having an arm portion and an elastic contact portion, the arm portion having a proximal end portion, a distal end and a pressing force receiving portion at the distal end for receiving a pressing force and from which the elastic contact portion extends, the arm portion being connected to an outer peripheral edge portion of the main body portion of the terminal plate at one side of the proximal end portion and being bent with respect to the outer peripheral edge portion at the one side of the proximal end portion, and the arm portion extending from the proximal end portion along an extension surface of the main body portion in a direction along the outer peripheral edge portion of the main body portion; and a rigid support lever movably provided relative to the pressing force receiving portion of the elastic switch lever portion, the rigid support lever having a rigid substrate portion and a rigid support wall portion that is connected to a distal end of the rigid substrate portion and that supports the pressing force receiving portion so as to receive a pressing force from the pressing force receiving portion and to guide displacement of the pressing force receiving portion when a pressing force is applied to the pressing force receiving portion.

25. An electronic timepiece having a switch structure as claimed in claim 24.

26. A chronograph mechanism comprising:

a start/stop switch structure comprised of a first elastic switch lever portion and a first rigid support lever, the first elastic switch lever portion having a first elastic contact portion and a first arm portion provided with a first pressing force receiving portion from which the first elastic contact portion extends, the first rigid support lever being mounted for undergoing movement relative to the first pressing force receiving portion, and the first rigid support lever having a first rigid substrate portion and a first rigid support wall portion connected to the first rigid substrate portion and supporting the first pressing force receiving portion so as to receive a pressing force from the first pressing force receiving portion and to guide displacement of the first pressing force receiving portion when a pressing force is applied to the first pressing force receiving portion;

a reset switch structure comprised of a second elastic switch lever portion and a second rigid support lever, the second elastic switch lever portion having a second elastic contact portion and a second arm portion provided with a second pressing force receiving portion from which the second elastic contact portion extends, the second rigid support lever being mounted for undergoing movement relative to the second pressing force receiving portion, and the second rigid support lever having a second rigid substrate portion and a second rigid support wall portion connected to the second rigid substrate portion and supporting the second pressing force receiving portion so as to receive a pressing force from the second pressing force receiving portion and to guide displacement of the second pressing force receiving portion when a pressing force is applied to the second pressing force receiving portion;

a start/stop button configured to exert a pressing force to the first pressing force receiving portion of the start/stop switch structure;

a reset button configured to exert a pressing force to the second pressing force receiving portion of the reset switch structure;

a chronograph indication hand for performing a time measurement operation;

a chronograph coupling lever mounted to undergo rotation in response to depression of the start/stop button to start or stop a time measuring operation of the chronograph indication hand; and a zero-restoring instruction lever mounted to undergo rotation in response to depression of the reset button to restore the chronograph indication hand to zero.

27. An electronic timepiece having a chronograph mechanism as claimed in claim 26.

* * * * *